US012736255B2

(12) United States Patent
Simon et al.

(10) Patent No.: US 12,736,255 B2
(45) Date of Patent: Sep. 15, 2026

(54) SYSTEM AND METHOD FOR OPERATING GROUND-SOURCE HEAT PUMPS

(71) Applicant: Schlumberger Technology Corporation, Sugar Land, TX (US)

(72) Inventors: Matthieu Simon, Clamart (FR); Olivier Lecoq, Clamart (FR); Andrew J. Parry, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 32 days.

(21) Appl. No.: 18/948,576

(22) Filed: Nov. 15, 2024

(65) Prior Publication Data

US 2025/0164156 A1 May 22, 2025

(30) Foreign Application Priority Data

Nov. 17, 2023 (EP) ..... 23307000

(51) Int. Cl.
*F24T 10/10* (2018.01)

(52) U.S. Cl.
CPC ..... *F24T 10/10* (2018.05)

(58) Field of Classification Search
CPC .... F24T 10/20; E21B 43/26; F25B 2313/002; F25B 30/06
See application file for complete search history.

(56) References Cited

U.S. PATENT DOCUMENTS

| | | | | |
|---|---|---|---|---|
| 8,020,382 | B1 | 9/2011 | Zakiewicz | |
| 9,360,236 | B2 | 6/2016 | Stewart et al. | |
| 2011/0220317 | A1* | 9/2011 | Kidwell | F24T 10/17 165/287 |
| 2011/0220320 | A1 | 9/2011 | Kidwell | |
| 2011/0224942 | A1* | 9/2011 | Kidwell | G01K 17/00 702/182 |
| 2012/0090807 | A1 | 4/2012 | Stewart et al. | |
| 2020/0049381 | A1 | 2/2020 | Thielmann | |
| 2021/0025623 | A1 | 1/2021 | Holtzman | |

FOREIGN PATENT DOCUMENTS

DE 2022116248 B3 6/2023

* cited by examiner

*Primary Examiner* — Jianying C Atkisson
*Assistant Examiner* — Khaled Ahmed Ali Al Samiri
(74) *Attorney, Agent, or Firm* — Kyle R. Miiller

(57) ABSTRACT

A method of operating a ground-source heat pump includes generating a thermal power based on a thermal communication of the ground-source heat pump with a borefield, the thermal power at least partly covering a thermal load of a facility. The method includes receiving a temperature associated with the borefield and controlling the thermal power based on the temperature. The method further includes maintaining the temperature within a temperature range based on controlling the thermal power, wherein the ground-source heat pump is configured to cause the temperature to fall outside of the temperature range at a full capacity of the thermal power.

14 Claims, 19 Drawing Sheets

| | Heat pump power capacity | Total drilled length [m] | Coverage heating – 25 year average [%] | Coverage cooling [%] |
|---|---|---|---|---|
| Conventional Configuration | 127 | 2671 | 80 | 92 |
| Configuration A | 150 | 2137 | 80 | 96 |
| Configuration B | 165 | 2671 | 90 | 99 |

FIG. 14

SYSTEM AND METHOD FOR OPERATING GROUND-SOURCE HEAT PUMPS

CROSS-REFERENCE TO RELATED APPLICATIONS

This application claims priority and the benefit of European Patent Application No. EP 23307000.2, filed on Nov. 17, 2023, which is hereby incorporated by reference in its entirety.

BACKGROUND OF THE DISCLOSURE

Ground-source or geothermal heat pump systems offer energy-efficient heating and cooling solutions by leveraging the relatively stable temperature of the Earth's subsurface. Depending on an amount of thermal energy extracted from the ground for heating during cold months of the year, and an amount of thermal energy injected into the ground for cooling during warm months of the year, ground-source heat pumps can cause a temperature of the ground on average to change over time. Accordingly, ground-source heat pumps are typically dimensioned proportionately to an associated borefield and ground heat exchanger such that the consecutive heating and cooling cycles over many years will not cause the ground temperature (represented by a fluid inlet temperature) to reach a threshold temperature until a predetermined time period, such as up to 25 or 50 years. Thus, the amount of thermal power that can be generated by the ground-source heat pump is generally limited or restricted by the size of the borefield in order to comply with the fluid inlet temperature requirements. Improvements to this conventional technique for generating more thermal power from a given size of borefield while still operating within the applicable temperature thresholds may be advantageous.

SUMMARY

In some embodiments, a method of operating a ground-source heat pump includes generating a thermal power based on a thermal communication of the ground-source heat pump with a borefield, the thermal power at least partly covering a thermal load of a facility. The method includes receiving a temperature associated with the borefield and controlling the thermal power based on the temperature. The method further includes maintaining the temperature within a temperature range based on controlling the thermal power, wherein the ground-source heat pump is configured to cause the temperature to fall outside of the temperature range at a full capacity of the thermal power. In some embodiments, the method is performed by a system. In some embodiments, the method is implemented as instructions stored on a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 shows an example thermal load for both heating and cooling of a facility for each hour over the course of a year; according to at least one embodiment of the present disclosure;

FIG. 2-2 shows the hourly thermal loads of FIG. 2-1 arranged from maximum to minimum;

FIG. 2-3 illustrates the area under the heating portion of the thermal load curve of FIG. 2-2;

FIG. 3 shows an example of the relationship between the total thermal energy provided and the power capacity of a ground-source heat pump, according to at least one embodiment of the present disclosure;

FIG. 8-1 is an example implementation of the thermal model 525 as described herein, according to at least one embodiment of the present disclosure;

FIG. 9-1 shows example fluid inlet and outlet temperatures for a thermal fluid flowing through the borefield heat exchanger of FIG. 1;

FIG. 9-2 shows example fluid inlet and outlet temperatures for a thermal fluid flowing through the borefield heat exchanger of FIG. 5 implementing an oversized ground-source heat pump;

FIG. 11-1 illustrates the thermal power provided by the conventional thermal system of FIG. 1;

FIG. 11-2 illustrates the thermal power provided by the thermal system of FIG. 5;

FIG. 13-1 illustrates the thermal energy produced by the ground-source heat pump of the conventional thermal system of FIG. 1;

FIG. 13-2 illustrates the thermal energy produced by the ground-source heat pump of the thermal system of FIG. 5;

FIG. 14 illustrates example metrics associated with the conventional thermal system of FIG. 1, as well as various configurations of the thermal system of FIG. 5;

DETAILED DESCRIPTION

Figure 1:
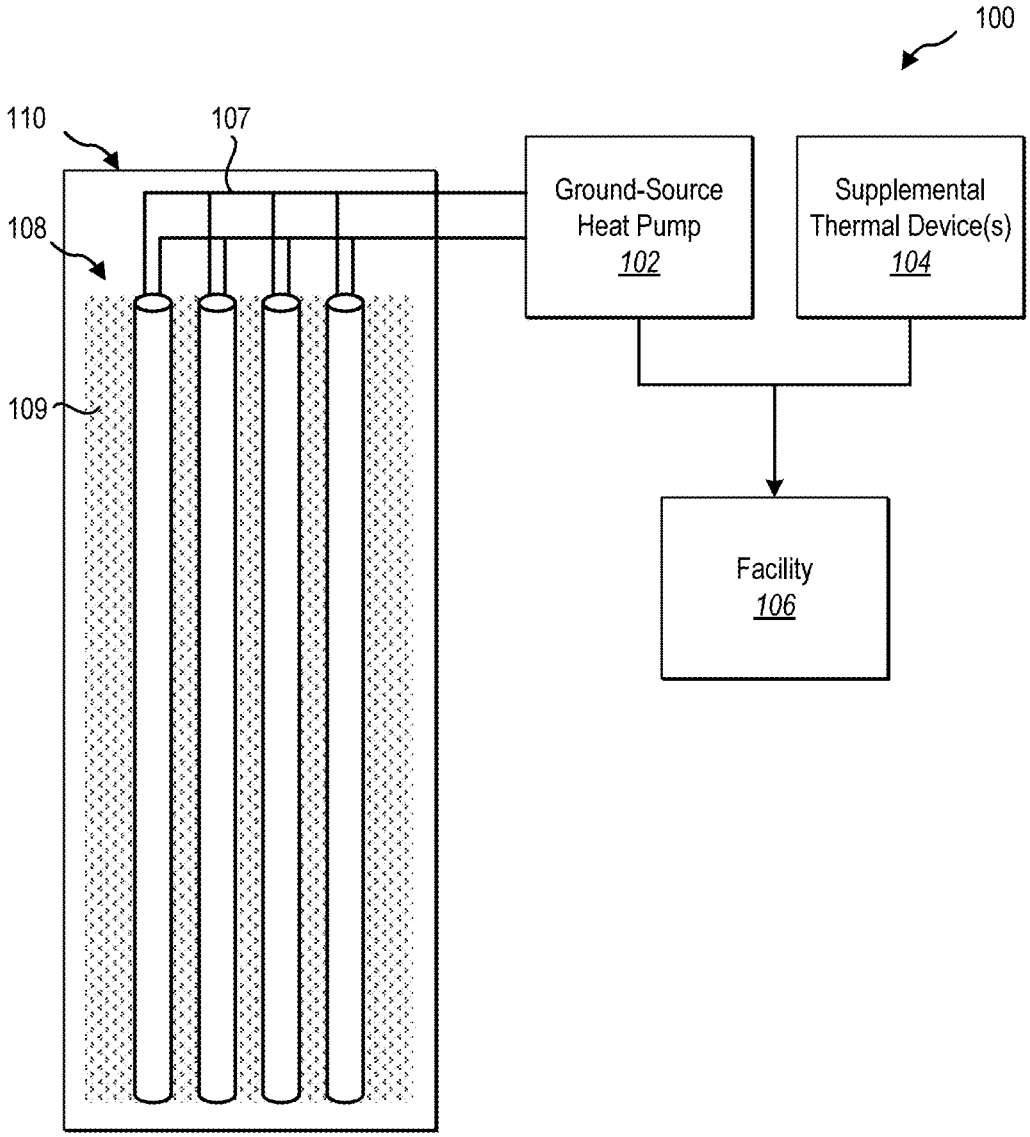
FIG. 1 is an example of a conventional thermal system, according to at least one embodiment of the present disclosure.

This disclosure generally relates to systems and methods for operating a ground-source heat pump. Ground-source heat pumps are typically used to extract thermal energy from the ground for providing heating and to inject thermal energy into the ground for providing cooling, for instance, for a commercial, residential, or industrial building. Through many consecutive cycles of extracting thermal energy and injecting thermal energy (e.g., throughout many years), and depending on an amount of heat extracted from the ground compared to an amount of heat injected into the ground (or vice versa), the ground-source heat pump may cause the ground temperature to change over time. A fluid inlet temperature of a thermal fluid flowing into the ground may impact the ground temperature and/or may be regulated in order to prevent damage to the ground from changing ground temperatures. Typically, ground-source heat pumps, or more specifically the thermal capacity of the ground-source heat pump, may be dimensioned proportionately to an associated borefield such that the ground-source heat pump will not cause the fluid inlet temperature to reach a threshold temperature, at least until a predetermined time period, such as 25 or 50 years. In other words, ground-source heat pumps are conventionally made to be compliant with fluid inlet temperature thresholds based on a sizing of the ground-source heat pump and/or borefield, even when operating at full capacity.

Thermal systems according to the techniques of the present disclosure, however, may implement ground-source heat pumps that are oversized in comparison to the associated borefield with respect to the conventional proportions. For example, the associated borefield may be smaller while maintaining a thermal power capacity of the ground-source heat pump the same, or even larger. In another example, the associated borefield may be substantially the same size, but the thermal power capacity of the ground-source heat pump may be increased. In this way, the ground-source heat pump may generate more thermal power, for example, by extracting more thermal energy from, or injecting more thermal energy into, the ground through the borefield. Also in this way, the ground-source heat pump may cause the ground temperature and/or the fluid inlet temperature to exceed the temperature threshold when operating at full capacity much sooner than the 25-year time-period, or even immediately, based on the ground-source heat pump being oversized, without detrimentally changing the ground temperature.

The present technique may implement a thermal management system for controlling the thermal power output of the ground-source heat pump. For example, the thermal management system may monitor the fluid inlet temperature against a temperature range, such as a temperature range between −2° C. and 40° C. In another example, the thermal management system may monitor a minimum borefield temperature of all locations of the borefield. The minimum borefield temperature may be an inferred minimum temperature based on a digital twin of the borefield. The digital twin may be generated by a thermal model that is calibrated and validated to accurately predict properties of the borefield in real time and generate a live temperature map of the borefield.

Based on the observed temperature(s) (e.g., measured and/or inferred temperatures) the thermal management system may control the thermal output of the ground-source heat pump to maintain the temperature(s) above the temperature range. This may facilitate generating an increased amount of thermal power with the ground-source heat pump (e.g., compared to conventional techniques) while still operating within the temperature thresholds, for example, to prevent the ground from freezing. In this way, the ground-source heat pump may generate substantially the same amount of thermal energy as the conventional example, but may do so with a reduced borefield. Alternatively, the ground-source heat pump may implement a same sized borefield as the conventional example, but may generate an increased amount of thermal energy to cover more of the thermal load of the facility.

As will be discussed in further detail below, the present disclosure includes a number of practical applications having features described herein that provide benefits and/or solve problems associated with operating a ground-source heat pump. Some example benefits are discussed herein in connection with various features and functionalities provided by a thermal management system implemented on one or more computing devices. It will be appreciated that benefits explicitly discussed in connection with one or more embodiments described herein are provided by way of example and are not intended to be an exhaustive list of all possible benefits of the thermal management system.

As mentioned, conventional thermal systems are configured to operate within temperature thresholds based on a dimensioning or sizing of the ground-source heat pump and borefield. This sizing may be based on modeling and predictions that the fluid inlet temperature will not reach the temperature threshold until a certain number of years. Models and predictions, however, are not infallible, and may be subject to inaccuracies, unforeseen circumstances, changing conditions, etc., that may result in the predictions becoming incorrect. Thus, fluid inlet temperatures may reach the temperature thresholds much earlier than expected, making the situation difficult to remedy and impacting the profitability of said systems. Additionally, even where the modelling is correct, in any case, the inlet temperatures will eventually reach the thresholds in which the thermal system may be limited in its effectiveness, efficiency, etc. (for instance, freezing the ground). In contrast, the thermal systems of the present disclosure operate based on the inlet temperature instead of working around it. By controlling the thermal output of the ground-source heat pump, the present thermal system ensures that the inlet temperature never exceeds the temperature threshold, both before the acceptable time limit and beyond. The inlet temperature having a direct impact on the ground temperature, this may ensure that the ground temperature remains within a certain preferred range for efficient operation of the system. This facilitates implementing and operating such a thermal system indefinitely without the risk of breaching the temperature threshold and, in some cases, freezing the ground.

By operating the ground-source heat pump based on the inlet temperature, the present techniques may facilitate generating an equivalent amount of thermal power to conventional methods, but with a smaller borefield. For example, operating the thermal system with an inlet temperature at or near the temperature threshold may enable the ground-source heat pump to extract/inject an increased amount of thermal energy from/to the ground. In other words, the ground-source heat pump may be operated at an increased capacity which may cause the inlet temperature to reach or surpass the temperature thresholds, but the ground-source heat pump may be actively controlled such that the inlet temperature does not exceed the temperature threshold. In this way, the present techniques may facilitate implementing a smaller borefield for an equivalent amount of thermal power output, which may provide cost savings associated with drilling and constructing the borefield, energy and emissions, operational expenses, maintenance and material expenses, etc., as well as increased profitability and sustainability of the system.

By operating the ground-source heat pump based on the inlet temperature, the present techniques may alternatively facilitate generating an increased amount of thermal power compared to conventional methods, while implementing the same sized borefield. For example, with the same borefield, a ground-source heat pump with a proportionately increased capacity may be implemented, which may result in even more thermal energy extracted from or injected into the ground. Similarly, the larger ground-source heat pump may cause the fluid inlet temperatures of the borefield to approach or surpass the temperature thresholds, but the larger ground-source heat pump may be controlled to prevent such from occurring. In this way, the present techniques may facilitate generating an increased amount of thermal energy that is cost- and energy-efficient, as well as renewable. This may additionally reduce CO2 emissions which would otherwise be generated through implementing less efficient heating and cooling means.

Additional details will now be provided regarding systems described herein in relation to illustrative figures portraying example implementations. FIG. 1 shows an example of a conventional thermal system 100 for facilitating transferring heat between one or more components. The thermal system 100 may typically include a ground-source heat pump (GSHP) 102. The GSHP 102 may be in thermal communication with a ground (or borehole) heat exchanger 110. The ground heat exchanger 110 may include a borefield 108 having one or more boreholes within a volume of ground 109 defining the borefield 108. One or more ground loops 107 may be positioned within the one or more boreholes, and the boreholes may be at least partially filled with a grout, for example, to maintain the ground loops 107 in place and to facilitate heat transfer between the ground loops 107 and the ground 109. The ground loops have a fluid inlet and a fluid outlet but may have any configuration in the wellbore, for instance coaxial or U-shaped. The ground loops 107 may be operatively coupled to the GSHP 102, and a thermal fluid may flow through the ground loops 107 to facilitate the thermal communication between the ground heat exchanger 110 and the GSHP 102.

The GSHP 102 may typically be in thermal communication with a facility heat exchanger of a facility 106. The GSHP 102 may include a compressor and an evaporator (e.g., expansion valve) for implementing a refrigerant cycle between the facility heat exchanger and a second heat exchanger in which both the refrigerant and the thermal fluid circulate. The heat from the facility 106 may then be transferred to the borefield 108, using the thermal fluid for cooling the facility, as well as to transfer heat from the borefield 108 to the facility 106, using the thermal fluid, to heat the facility 106. In this way, the GSHP 102 may be a geothermal heat pump for leveraging the thermal properties and conditions within the ground 109 to provide energy- and cost-efficient heating and cooling to the facility 106.

The conventional thermal system 100 may typically include one or more supplemental thermal devices 104 for providing heating and/or cooling to the facility 106. For example, the supplemental thermal devices 104 may include one or more heating devices such as a boiler, furnace, or any other heating device. The supplemental thermal devices 104 may also include one or more cooling devices such as a chiller, cooling tower, fin-fan cooler, or any other cooling device. The supplemental thermal devices 104 may be configured to provide heating and/or cooling to the facility 106 in addition to or in parallel with the GSHP 102. For example, the GSHP 102 and ground heat exchanger 110 may be dimensioned and configured to at least partly cover the thermal load of the facility 106, and the remaining portion may be covered by the supplemental thermal devices 104. This split nature of the heating and cooling may typically be dictated by a cost function analysis which balances the energy and cost savings of the GSHP 102 and ground heat exchanger 110 with the associated initial installation and operational expenses.

Figures 1, 2:
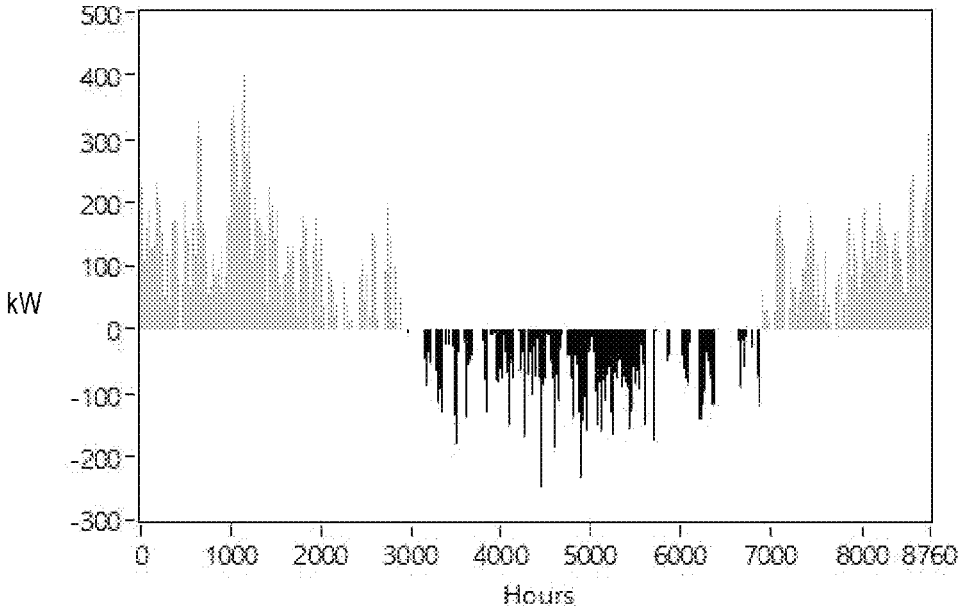
Figure 2:
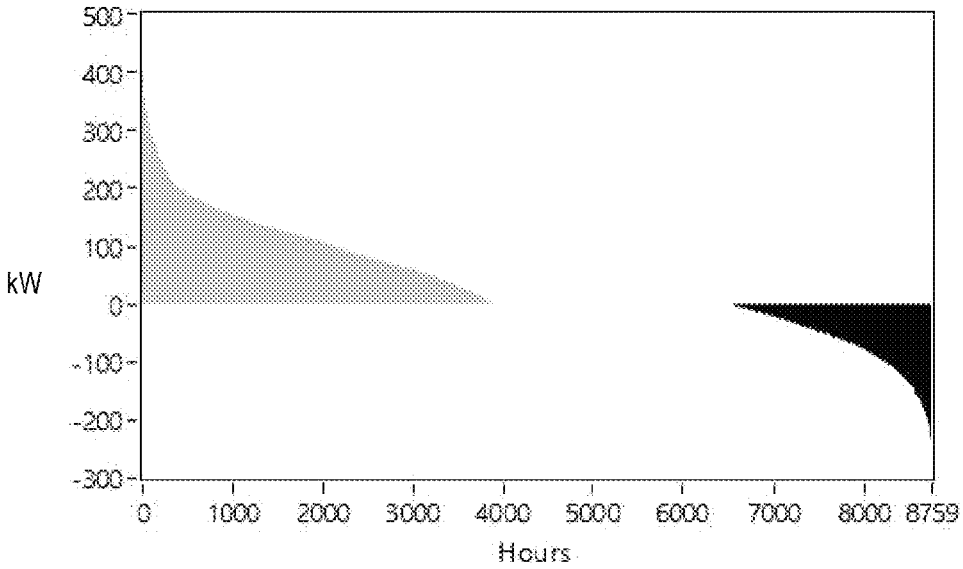

Designing and implementing the thermal system 100 may typically involve determining the thermal load requirements of the facility 106. FIG. 2-1 shows an example thermal load for both heating (positive) and cooling (negative) of the facility 106 for each hour over the course of a year. FIG. 2-2 shows the same hourly thermal loads arranged from maximum to minimum. The thermal loading may be observed and/or simulated for the facility 106. As can be seen, the peak thermal load of the facility 106 can be determined to be approximately 400 kW for heating and approximately −350 KW for cooling, for this example. Thus, the thermal system 100 may typically be sized and configured to generate a peak thermal power of 400 kW in order to meet the peak thermal needs of the facility 106, for example, at the coldest hour on the coldest day of the year. The values used for the thermal loads for heating and/or cooling are intended to be illustrative, and may be any other value(s).

Figures 2, 3:
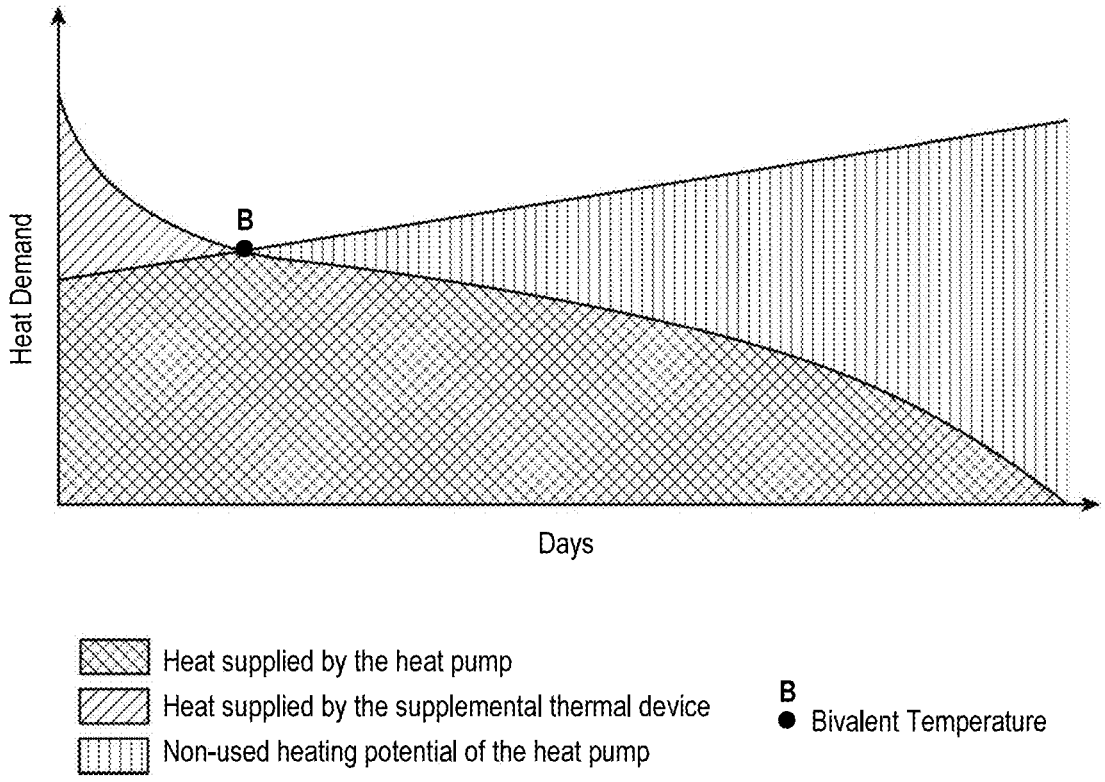
Figure 3:
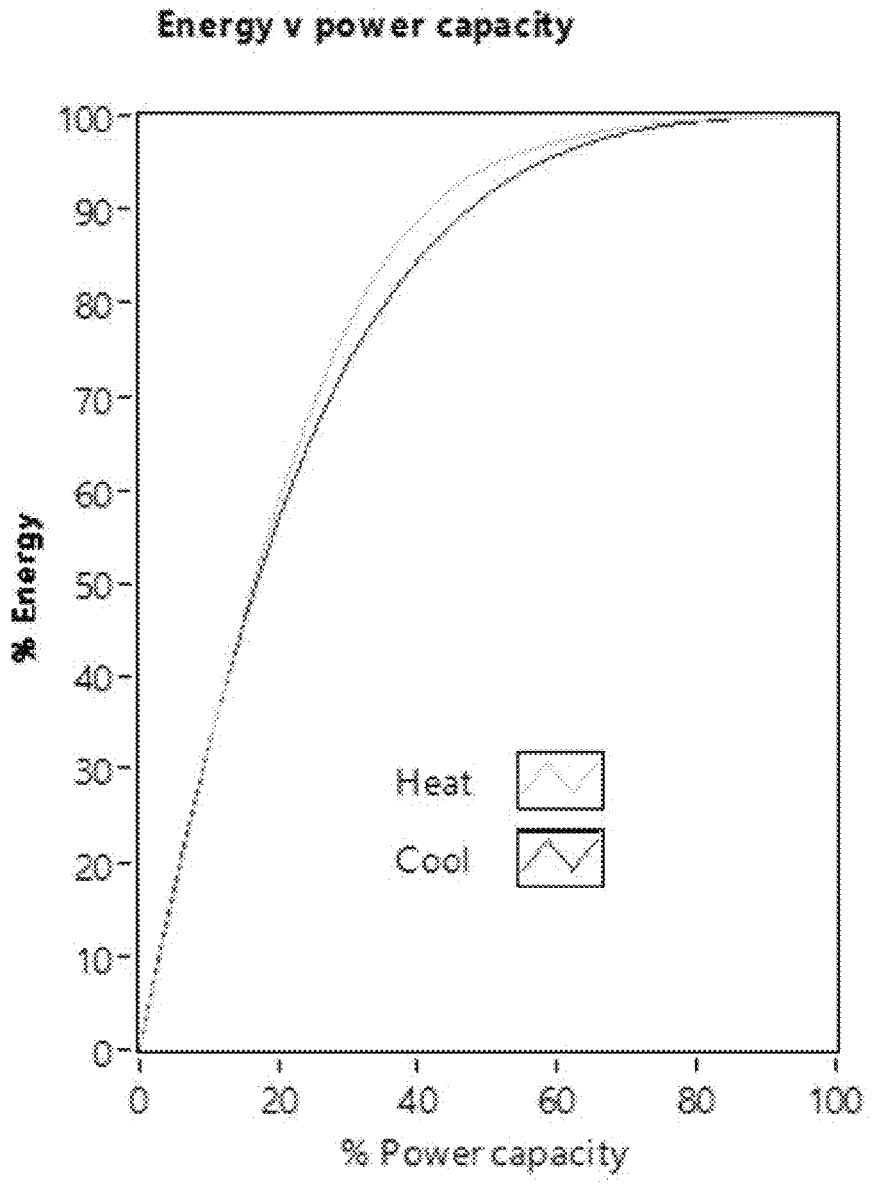

FIG. 2-2 shows the values of FIG. 2-1 re-arranged in decreasing order. The area under the positive part of the curve of FIG. 2-2 represents the total thermal energy provided to the facility 106 for heating over the course of a year. The area under the negative part of the curve is similarly the total thermal energy removed from the facility 106 for cooling. As mentioned above, the thermal power of the thermal system 100 may be at least partly provided to the facility 106 by the GSHP 102 and partly by the supplemental thermal devices 104 as needed. FIG. 2-3 illustrates the area under the heating portion of the thermal load curve of FIG. 2-2. As shown, the GSHP 102 may typically be configured to provide only a portion of the peak thermal loads. However, while the GSHP 102 may not meet all of the peak demands, as shown, the GSHP 102 may provide a large portion of the total thermal energy to the facility 106 for heating over the course of the year.

The conventional thermal system 100 may typically be configured such that when the facility 106 calls for heating or cooling, the GSHP 102 operates at full capacity to meet the thermal load of the facility 106. If the GSHP 102 alone meets the demand, the supplemental thermal device 104 may be shut off until the facility 106 again calls for heating or cooling. Alternatively, if the GSHP 102 cannot meet the demand, the supplemental thermal device 104 may be activated to provide additional thermal power to meet the thermal load. In this way, the GSHP 102 is configured to operate, when activated, at full capacity.

FIG. 3 shows an example of the relationship between the total thermal energy provided and the power capacity (e.g., peak thermal power output) of the GSHP 102, further illustrating this principle. As shown, configuring the GSHP 102 to cover 100% (e.g., all 400 kW) of the peak thermal power demand of the facility 106 may come at the cost of diminished returns. For example, peak thermal loads may occur infrequently such that only a portion of that peak capacity may be needed most of the time. Thus, conventionally, the GSHP 102 may be sized and configured to cover less than 100% of the peak thermal loads, while still providing a significant amount of the total thermal energy. For example, as shown, by sizing the GSHP 102 with a thermal power capacity that can cover only about 30% of the peak thermal power (e.g., 127 kW), the GSHP 102 can still provide about 80% of the total thermal energy for the facility 106 for the year. The thermal system 100 may accordingly be configured with supplemental thermal devices 104 that cover up to 70% of the thermal load during peak hours, but may represent a small portion of the total thermal energy provided by the thermal system 100 over the course of a year (e.g., 20%). As the GSHP 102 may typically be much more energy-efficient than the supplemental thermal device 104, up to 80% of the thermal energy for the facility 106 may be provided through these energy-efficient means, resulting in significant cost and energy savings.

Limiting the thermal power capacity of the GSHP 102 in this way may additionally provide initial or start-up savings associated with the construction and installation of the GSHP 102 and the ground heat exchanger 110. For example, a significant amount of the expense of implementing a GSHP 102 may be associated with drilling and completing the boreholes of the borefield 108. Additionally, space may limit the quantity, arrangement, or configuration of the boreholes. Limiting the power capacity of the GSHP 102 (e.g., to 30%) may in turn result in a reduced number of boreholes or reduced length of ground loops 107 that are needed for the operation of the GSHP 102. Thus, significant up-front capital savings may be achieved by implementing the supplemental thermal devices 104 in addition to the GSHP 102.

Typically, the borefield 108 of the ground heat exchanger 110 may be dimensioned proportionately to the GSHP 102. For instance, a quantity of boreholes and/or a quantity of total linear feet of the ground loops 107 may be proportionate to the thermal capacity of the GSHP 102. In some embodiments, extracting heat from the ground 109 (e.g., during heating) and/or injecting heat to (e.g., during cooling) above that for which the ground heat exchanger 110 is sized and configured may result in the ground temperature changing. The changing ground temperature may adversely affect the ability of the GSHP 102 to provide heating and/or cooling. In some cases, the ground may freeze, which may damage and/or further inhibit the operation of the ground heat exchanger 110. Accordingly, the ground heat exchanger 110 (e.g., more specifically, the borefield 108) may be sized proportional to an amount of thermal energy the GSHP 102 is configured to extract and/or inject.

Figure 4:
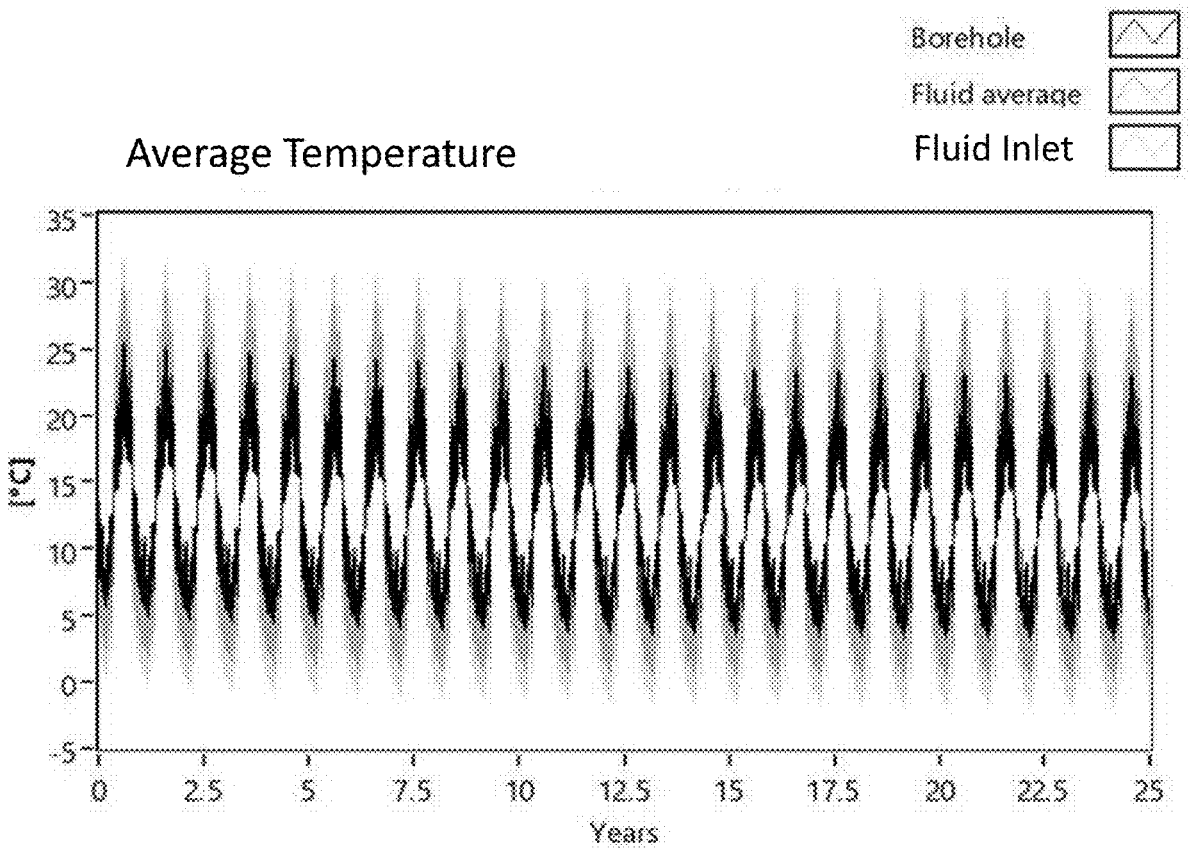
FIG. 4 illustrates an example of the temperature change over time for a borefield, according to at least one embodiment of the present disclosure.

FIG. 4 illustrates an example of the temperature change over time for the borefield 108. As mentioned, the GSHP 102 may typically be operated at full capacity when the facility 106 calls for heating and/or cooling. The borefield 108 may accordingly be dimensioned such that at full capacity (including during continual operation of the GSHP 102 at full capacity), one or more temperatures associated with the borefield 108 remain within a predetermined temperature threshold (e.g., range). For example, the borefield 108 may be sized such that an average borehole temperature (e.g., of one or more boreholes, at one or more locations, and/or at one or more depths) remains within a temperature threshold. In another example, the borefield 108 may be sized such that a parameter relative to a fluid inlet temperature of the thermal fluid flowing into the ground heat exchanger 110, such as the fluid inlet temperature and/or an average fluid temperature between the thermal fluid flowing into and out of the ground heat exchanger 110 remains within one or more temperature thresholds. A temperature threshold for the borehole temperature may include a lower limit above freezing, such as 2° C., 3° C., 4° C., 5° C., or any other temperature. A temperature threshold for the fluid inlet temperature may have a lower limit of −3° C., −2° C., −1° C., 0° C., or any other temperature that is considered as not detrimental for the borefield. In some embodiments, a temperature threshold for the borehole temperature includes an upper limit, such as 36° C., 37° C., 38° C., 39° C., 40° C., or any other temperature. A temperature threshold for the fluid inlet temperature may have an upper limit, such as 38° C., 39° C., 40° C., 41° C., 42° C., or any other temperature that is considered as not detrimental for the borefield.

The temperature thresholds may help to prevent damage to the ground 109 due to changing temperatures based on thermal energy injected into and/or extracted from the ground 109 by the GSHP 102. For example, the temperature range(s) having a lower limit may help to prevent the ground 109 from freezing. In some embodiments, the local regulations dictate the upper and/or lower limits of the temperature range(s) for the fluid inlet temperature, such as between −2° C. and 40° C. For the purposes of illustration, the discussion herein may specifically reference the fluid inlet temperature for monitoring and/or comparing to a temperature threshold in order to achieve the features and functionalities of the present disclosure. It should be understood, however, that one or more temperatures and/or temperature thresholds may be utilized in accordance with that discussed herein in addition to, or as an alternative to, the fluid inlet temperature.

In a conventional system, operation of the GSHP 102 causes the temperature of the ground 109 to change over time. As shown in FIG. 4, the temperatures fluctuate cyclically throughout a single year, and in this particular example, decrease on average over the course of 25 years. Other example implementations may see an increase in average temperature (or a relatively constant temperature average) over the course of many years. The change in average temperature may typically be due to the disparity between the amount of thermal energy injected into the ground 109 (e.g., during cooling) and the amount of thermal energy extracted from the ground 109 (e.g., during heating). Implementing the temperature threshold(s) (and in many cases the governmental regulation) as discussed may be in an effort to prevent or reduce the temperature change over time. The specific values illustrated and described in connection with FIGS. 2-4 are used for the purpose of explaining one illustrative example. It should be understood that the values, metrics, parameters, etc., may take any form or value consistent with that described herein.

As shown in FIG. 4, the fluid inlet temperature does not reach −2° C. until nearly 25 years. This is typically by design based on the dimensioning of the GSHP 102 and borefield 108, as described. In many cases, 25 years (or any other predetermined time period) may represent a useful or expected life of one or more components of the thermal system 100, at which point the thermal system 100 may be updated, redesigned, reconfigured, etc. In this way, conventional techniques may size and configure the GSHP 102 and/or the borefield 108 based on the predicted temperature change over time, such as that shown in FIG. 4.

Figure 5:
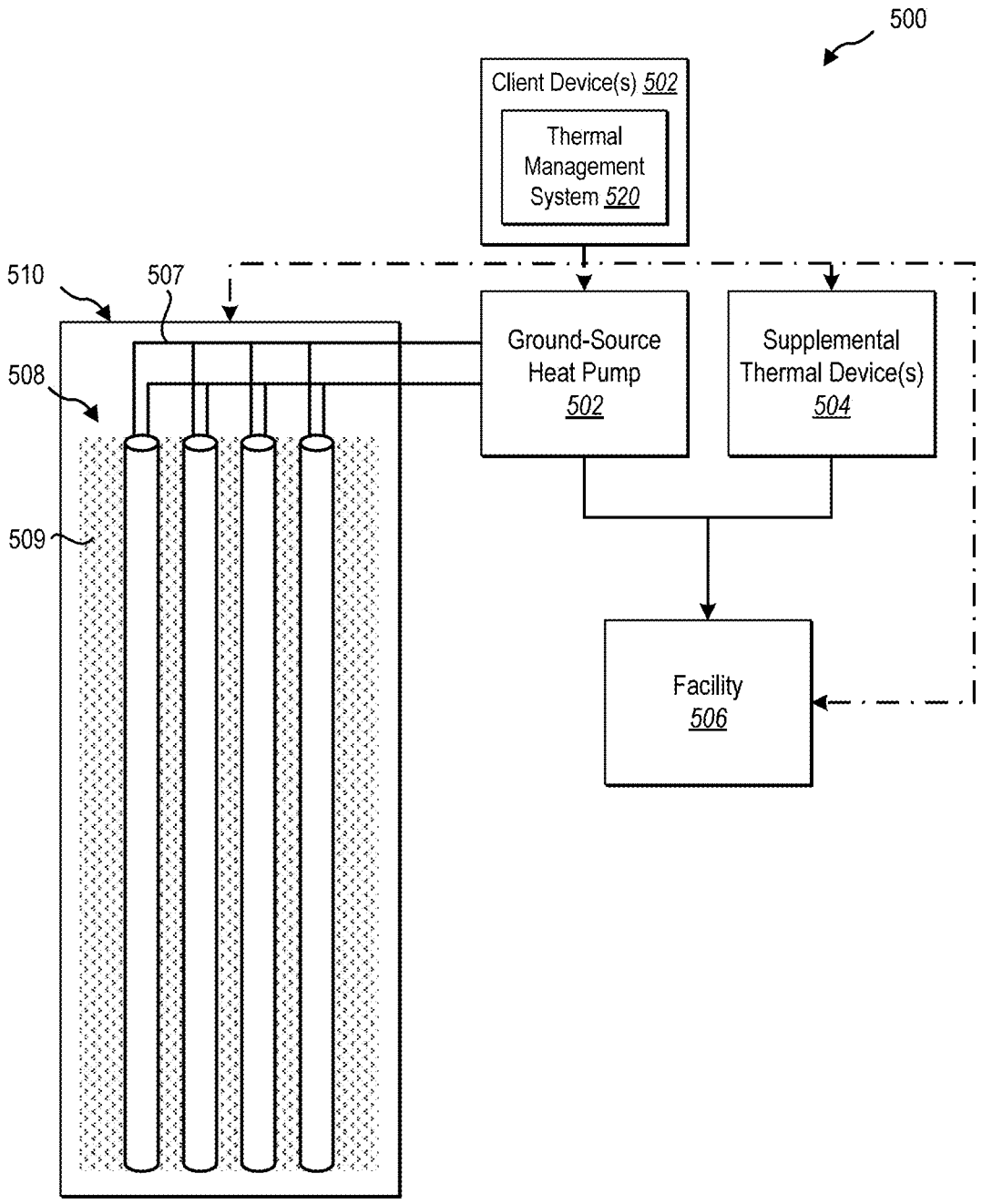
FIG. 5 shows an example of a thermal system, according to at least one embodiment of the present disclosure.

FIG. 5 shows an example of a novel thermal system 500 for facilitating the transfer of heat between one or more components, according to at least one embodiment of the present disclosure. The thermal system 500 may include one or more components similar to those of the conventional thermal system 100, such as a GSHP 502 and supplemental thermal devices 504 for providing thermal power to a facility 506. The GSHP 502 may be in thermal communication with a ground heat exchanger 510 through one or more ground loops 507. A thermal fluid may flow through the ground loops 507 to facilitate thermal communication. The ground heat exchanger 510 may include a borefield 508 having one or more boreholes positioned within the ground 509.

The thermal system 500 may additionally include a thermal management system 520 implemented on one or more computing devices, such as one or more client devices 512. As shown, the thermal management system 520 may be in communication with one or more components of the thermal system 500 (e.g., via the network 516 as described in connection with FIG. 7). In some embodiments, the thermal management system 520 is in communication with one or more of the ground heat exchanger 510, the GSHP 502, the supplemental thermal devices 504, and the facility 506. The thermal management system 520 may be in communication with any other component or system associated with the thermal system 500 consistent with that described herein.

Figure 6:
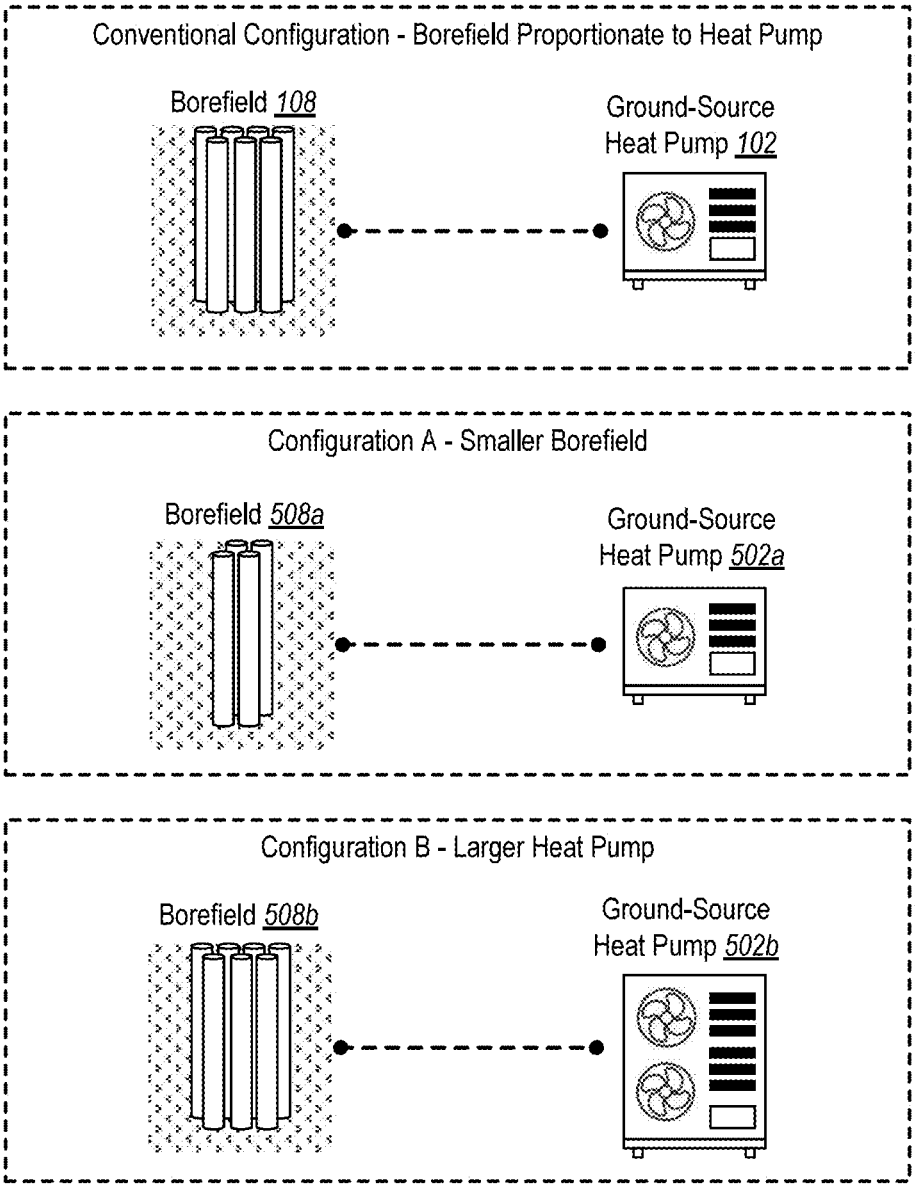
FIG. 6 illustrates example configurations of the thermal system of FIG. 5 in comparison to the conventional thermal system of FIG. 1, according to embodiments of the present disclosure.

FIG. 6 illustrates example configurations of components of the thermal system 500 of FIG. 5 in comparison to the conventional thermal system 100 of FIG. 1, according to embodiments of the present disclosure. As discussed above in connection with FIGS. 1-4, conventional techniques for implementing the conventional thermal system 100 may operate the GSHP 102, when activated, at a full capacity. The thermal system 100 may be made to maintain one or more temperatures within certain temperature thresholds based on a sizing of the GSHP 102 and the borefield 108. Accordingly, the conventional configuration shown in FIG. 6 may represent the conventional techniques for sizing the borefield 108 proportionate to the GSHP 102. The thermal system 500 of the present disclosure, however, may be implemented with a variety of configurations which do not follow the proportionate approach of the conventional configuration, and in this way may be in contrast to the conventional techniques of the thermal system 100. For purposes of this comparison, it should be understood that the thermal system 100 and the thermal system 500 are similar in that they have similar facilities having similar thermal load requirements, are located in similar climates, etc. Indeed, the thermal system 100 and the thermal system 500 may be substantially the same with the exception of the notable differences discussed below.

In some embodiments, the thermal system 500 is implemented with a configuration A in which the GSHP 502 is represented by a GSHP 502*a* and the borefield 508 is represented by a borefield 508*a*. Configuration A may be a configuration in which the GSHP 502*a* has a thermal power capacity that is the same as_or similar to (or even larger than) the GSHP 102 of the conventional configuration, but the borefield 508*a* is notably dimensioned smaller than the borefield 108. For example, the borefield 508*a* may be 80% the size of the borefield 108, such as by having 80% of the amount of boreholes, 80% of the total drilled length of boreholes, 80% of the total length of ground loops 507, etc. (and combinations thereof). In this way, the GSHP 502*a* may be oversized as compared to the borefield 508*a* (e.g., according to conventional proportions). In some embodiments, the thermal system 500 implements a configuration B in which the GSHP 502 is represented by a GSHP 502*b* and the borefield 508 is represented by a borefield 508*b*. Configuration B may be a configuration in which the borefield 508*b* is dimensioned the same as or similar to the borefield 108 of the conventional configuration, but the GSHP 502*b* may notably have a thermal power capacity that is larger than the GSHP 102. For example, the thermal capacity of the GSHP 502*b* may be 30% larger than the thermal capacity of the GSHP 102. In this way, the GSHP 502*b* may similarly be oversized as compared to the borefield 508*b* (e.g., according to conventional proportions). The various features, functionalities, benefits, and advantages of the thermal system 500 including the thermal management system 520 will be discussed herein with respect to the thermal system 500 implementing configuration A and/or configuration B.

Figure 7:
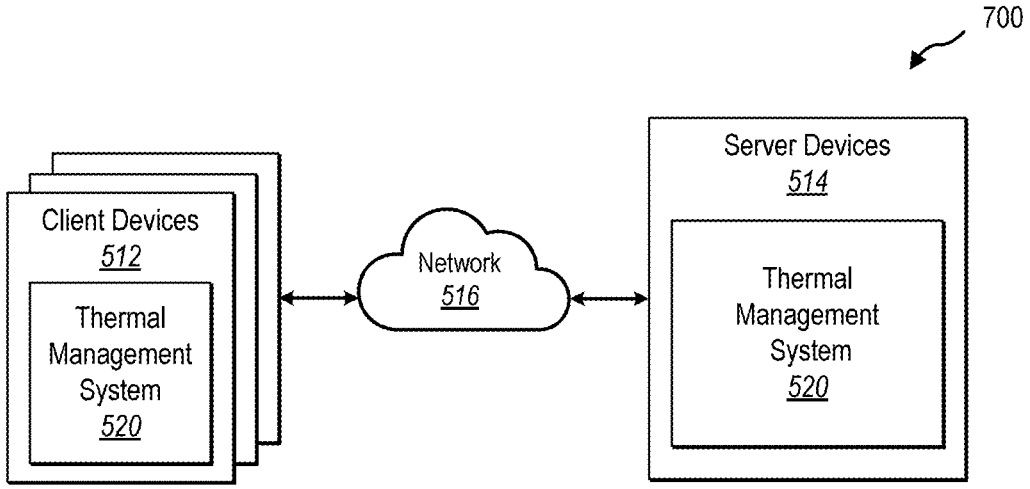
FIG. 7 illustrates an example environment in which a thermal management system is implemented, according to at least one embodiment of the present disclosure.

FIG. 7 illustrates an example environment 700 in which a thermal management system 520 is implemented in accordance with one or more embodiments described herein. As shown in FIG. 7, the environment 700 includes one or more server device(s) 514. The server device(s) 514 may include one or more computing devices (e.g., including processing units, data storage, etc.) organized in an architecture with various network interfaces for connecting to and providing data management and distribution across one or more client systems. As shown in FIG. 7, the server devices 514 may be connected to and may communicate with (either directly or indirectly) one or more client devices 512 through a network 516. The network 516 may include one or multiple networks and may use one or more communication platforms or technologies suitable for transmitting data. The network 516 may refer to any data link that enables transport of electronic data between devices of the environment 700. The network 516 may refer to a hardwired network, a wireless network, or a combination of a hardwired network and a wireless network. In one or more embodiments, the network 516 includes the internet. The network 516 may be configured to facilitate communication between the various computing devices via any protocol or form of communication.

The client device 512 may refer to various types of computing devices. For example, one or more client devices 512 may include a mobile device such as a mobile telephone, a smartphone, a personal digital assistant (PDA), a tablet, a laptop, or any other portable device. Additionally, or alternatively, the client devices 512 may include one or more non-mobile devices such as a desktop computer, server device, surface or downhole processor or computer (e.g., associated with a sensor, system, function, etc., of the thermal system 500), or other non-portable device. In one or more implementations, the client devices 512 include graphical user interfaces (GUI) thereon (e.g., a screen of a mobile device). In addition, or as an alternative, one or more of the client devices 512 may be communicatively coupled (e.g., wired or wirelessly) to a display device having a graphical user interface thereon for providing a display of system content. The server device(s) 514 may similarly refer to various types of computing devices. Each of the devices of the environment 700 may include features and functionalities described below in connection with FIG. 17.

As shown in FIG. 7, the environment 700 may include a thermal management system 520 implemented on one or more computing devices. The thermal management system 520 may be implemented on one or more client device 512, server devices 514, and combinations thereof. Additionally, or alternatively, the thermal management system 520 may be implemented across the client devices 512 and the server devices 514 such that different portions or components of the thermal management system 520 are implemented on different computing devices in the environment 700. In this way, the environment 700 may be a cloud computing environment, and the thermal management system 520 may be implemented across one or more devices of the cloud computing environment in order to leverage the processing capabilities, memory capabilities, connectivity, speed, etc., that such cloud computing environments offer in order to facilitate the features and functionalities described herein.

Figure 8:
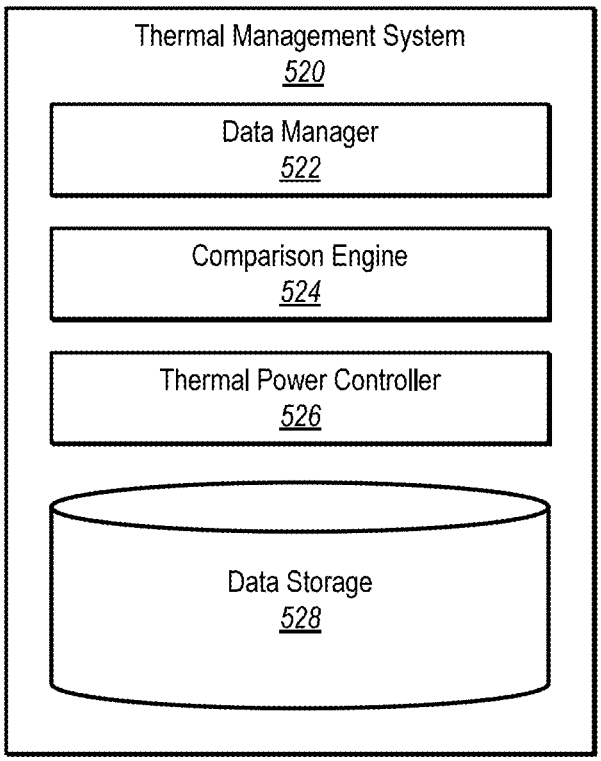
FIG. 8 illustrates an example implementation of a thermal management system, according to at least one embodiment of the present disclosure.
Figures 1, 8:
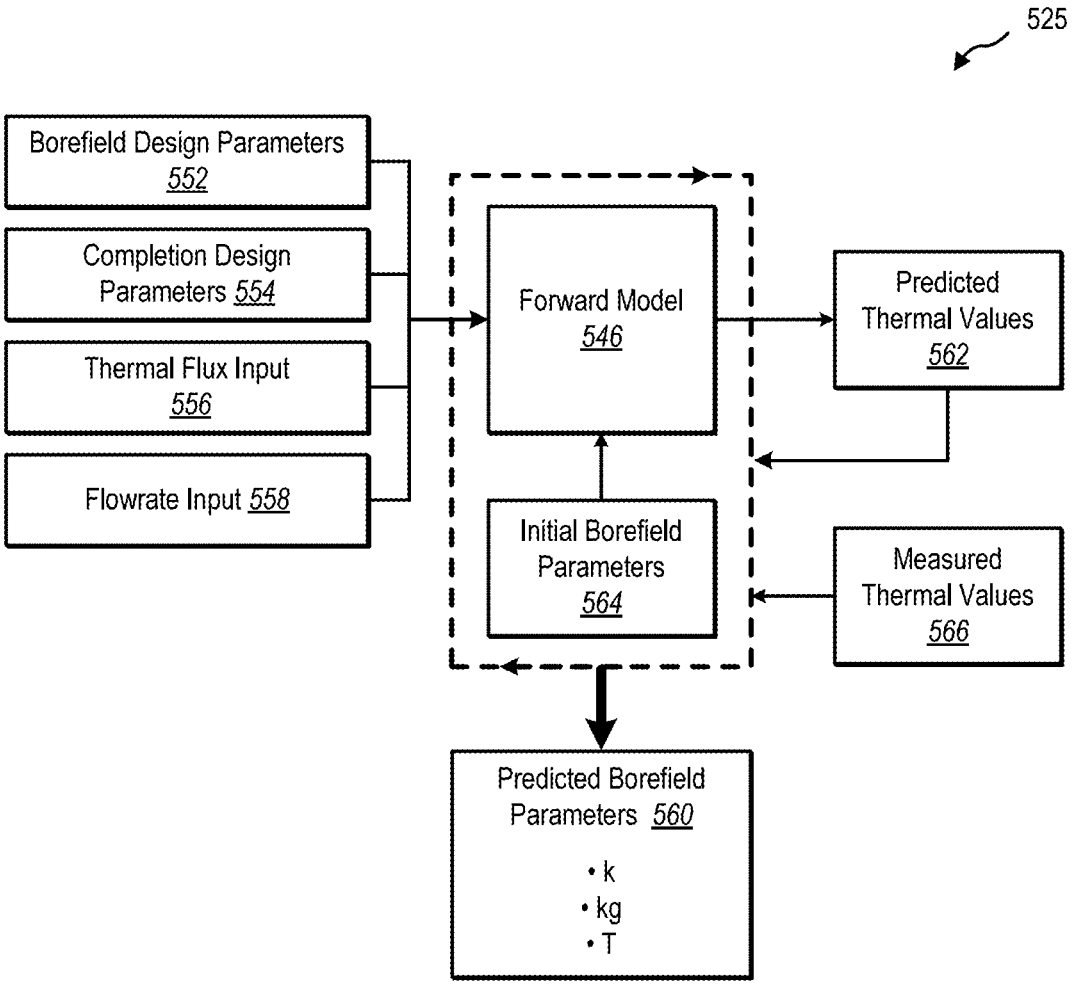

FIG. 8 illustrates an example implementation of the thermal management system 520 as described herein, according to at least one embodiment of the present disclosure. The thermal management system 520 may include a data manager 522, a comparison engine 524, and a thermal power controller 526. The thermal management system 520 may also include a data storage 528 having data stored thereon. While one or more embodiments described herein describe features and functionalities performed by specific components 522-526 of the thermal management system 520, it will be appreciated that specific features described in connection with one component of the thermal management system 520 may, in some examples, be performed by one or more of the other components of the thermal management system 520.

By way of example, one or more of the data receiving, gathering, and/or storing features of the data manager 522 may be delegated to other components of the thermal management system 520. As another example, while data may be processed and/or compared by the comparison engine 524, in some instances, some or all of these features may be performed by the thermal power controller 526, or any other component of the thermal management system 520. Indeed, it will be appreciated that some or all of the specific components may be combined into other components and specific functions may be performed by one or across multiple of the components 522-526 of the thermal management system 520.

Additionally, while FIG. 5, for example, depicts the thermal management system 520 implemented on a client device 512 of the thermal system, it should be understood that some or all of the features and functionalities of the thermal management system 520 may be implemented on or across multiple client devices 512 and/or server devices 514. For example, data may be received by the data manager 522 on a (e.g., local) client device, and the data may be input to one or more models or feedback loops implemented by the comparison engine 524 on a remote, server, and/or cloud device. Indeed, it will be appreciated that some or all of the specific components 522-526 may be implemented on or across multiple client devices 512 and/or server devices 514, including individual functions of a specific component being performed across multiple devices.

As mentioned above, the thermal management system 520 includes a data manager 522. The data manager 522 may receive and manage a variety of types of data of the thermal management system 520. In some embodiments, the data manager 522 receives sensor data. The sensor data may include measurements from any number of sensors included or associated with the thermal system 500. For example, the sensor data may include flow measurements, temperature measurements, and/or pressure measurements of the thermal fluid at one or more locations in the thermal system 500. The sensor data may include temperature measurements at one or more locations of the borefield, such as ground temperatures, borehole temperatures, grout temperatures, ambient temperatures, or any other temperature. The sensor data may be real-time data and/or may include data taken over a measurement period having one or more statistical calculations performed thereon (e.g., maximum, minimum, average, median, etc.). In this way, the data manager 522 may receive sensor data associated with one or more real-time or active properties of the thermal system 500.

In some embodiments, the data manager 522 receives inferred data, such as one or more inferred values representative of one or more properties or parameters of the thermal system 500. For example, in some embodiments, one or more temperatures are inferred for one or more locations of the borefield 508. For example, the thermal management system 520 may be in communication with a digital twin of the borefield 508, such as that discussed herein in connection with FIG. 15. The digital twin may be generated by a thermal model (discussed herein in connection with FIG. 8-1) which may mathematically and/or thermodynamically model the thermal response of the thermal system 500. The thermal model may include a forward model and may invert the forward model for predicting one or more parameters of the thermal system 500. The thermal model may be based on one or more measured values, such as temperature(s) and/or flowrate(s) of the thermal fluid. The thermal model may be based on a design (e.g., geometry) of the borefield 508 and/or the completion of the boreholes. Based on the model predictions, the thermal model may generate the digital twin of the borefield, which may include a detailed temperature field or temperature map inferring the temperature at one or more (or all) locations of the borefield. As discussed herein, this may facilitate determining the minimum (e.g., inferred) borefield temperature.

FIG. 8-1 is an example implementation of the thermal model 525 as described herein, according to at least one embodiment of the present disclosure. As shown, the thermal model 525 may include a forward model 546. The forward model 546 may be a physical model of the ground heat exchanger 510. For example, the forward model 546 may be a computational tool that simulates and/or predicts the thermal behavior of the borefield 508, the ground 509, the boreholes, etc. The forward model 546 may receive (or may be based on) one or more parameters, and based on receiving one or more inputs, the forward model 546 may predict or estimate one or more output values. In this way, the forward model 546 may provide a detailed representation of the thermal response of the ground heat exchanger 510 due to heat transfer.

In some embodiments, the forward model 546 receives (or is based on) one or more borefield design parameters 552. The borefield design parameters 552 may include information related to the one or more boreholes of the borefield 508, such as a trajectory, length, diameter, location, position, layout, configuration, etc., of the boreholes. The borefield design parameters 552 may include any of the design data 536 related to the borefield as described herein.

In some embodiments, the forward model 546 receives (or is based on) one or more completion design parameters 554. The completion design parameters 554 may include information related to the completion of the boreholes of the borefield 508, such as a diameter, configuration, length, arrangement, shank spacing, etc., of the ground loops 507. The completion design parameters 554 may include thermal properties of the ground loops 507 and/or of the thermal fluid circulated in the ground loops 507.

In some embodiments, the forward model 546 receives (or is based on) one or more initial conditions, such as initial borefield parameters 564. The initial borefield parameters 564 may include information related to one or more properties of the borefield 508, such as an initial thermal conductivity of the ground 509, an initial thermal conductivity of the grout, and/or an initial average temperature of the ground 509. One or more of the initial borefield parameters 564 may be initial conditions in that they may be initial starting points or estimates of the borefield parameters for use in simulating the thermal response with the forward model 546 (e.g., to output the predicted thermal values 562). As described below, one or more of the initial borefield parameters 564 may be variables that may be manipulated or changed through implementation of the inverted model 548 in order to determine one or more of the predicted borefield parameters 560.

The forward model 546 may receive (or may be based on) any other parameter. For example, the forward model 546 may receive one or more boundary conditions such as an ambient air temperature, heat pump condition (e.g., compressor and/or evaporator temperature), heat pump state (e.g., on/off), or any other factor that may influence the heat transfer process. The borefield design parameters 552 and/or the completion design parameters 554 may include information from the data storage 528. In some embodiments, the borefield design parameters 552 and/or the completion design parameters 554 may be static inputs and, as just mentioned, one or more of the initial borefield parameters 564 may be variables.

In some embodiments, the forward model 546 receives one or more dynamic inputs, or measurement inputs. The measurement inputs may be associated with a flow of the thermal fluid through the ground heat exchanger 510. For example, the forward model 546 may receive a thermal flux input 556. The thermal flux input 556 may be a measure of a rate of energy transferred between the thermal fluid and the ground 509 as a result of the thermal fluid flowing through the ground loops 507 (e.g., energy per unit area per unit time, $W/m^2$). The thermal flux input 556 may be measured at one or more locations of the ground heat exchanger 510, and may be from sensor data.

In some embodiments, the measurement inputs include a flowrate input 558. The flowrate input 558 may include a volumetric flow rate and/or a mass flow rate of the thermal fluid flowing through the ground heat exchanger 510. The flowrate input 558 may be measured at one or more locations of the ground heat exchanger 510, and may be part of the sensor data 538.

The forward model 546 being based on the borefield design parameters 552, the completion design parameters 554, and the initial borefield parameters 564 in this way may facilitate accurately simulating the heat transfer processes of the thermal system 500 (e.g., due to the inputs 556 and/or 558). For example, the forward model 546 may account for factors such as geophysical properties of the ground 509, the configuration of the borefield 508, and operational parameters of the GSHP 502. The forward model 546 may implement numerical techniques for capturing the interplay between one or more of the inputs and/or parameters in order to accurately characterize the thermal response of the ground heat exchanger 510. For example, the forward model 546 may incorporate mathematical heat transfer equations, such as a g-function, that describe conductive, convective, radiative, and/or advective heat transfer within the thermal system 500, as well as the transient nature of heat transfer at changing temperatures. The forward model 546 may implement numerical calculations, finite element analyses, or any other techniques for modeling and solving the heat transfer of the thermal system 500.

In this way, the forward model 546 may model the temperature distribution and variation within the ground 509 over one or more discrete time intervals in response to a thermal rejection to (or thermal extraction from) the ground 509 by the thermal fluid and/or the ground loops 507. For example, the forward model 546 may include or may be based on robust heat transfer dynamics and/or equations that capture faster transients within the thermal system 500. In these situations, the forward model 546 may implement time intervals, such as every 1-5 minutes to simulate a more detailed or faster thermal response of the thermal system 500. In another example, the forward model 546 may include or may be based on more general or balanced thermodynamics and may accordingly implement longer time intervals, such as every 1-5 hours to simulate a more general thermal response or equilibrium of the thermal system 500 over a longer time period.

In some embodiments, the forward model 546 outputs or predicts one or more predicted thermal values 562. The predicted thermal values 562 may include predicted values associated with the thermal fluid, such as a predicted inlet temperature of the thermal fluid flowing into the ground heat exchanger 510, a predicted outlet temperature of the thermal fluid flowing out of the ground heat exchanger 510, a predicted pressure drop of the thermal fluid at or across one or more locations of the ground heat exchanger 510. The predicted thermal values 562 may include predicted values associated with the ground 509, such as a predicted temperature at one or more locations of the ground 509. In some embodiments, the predicted thermal values 562 are values or parameters of the thermal system 500 that will or can be measured or observed. For example, the predicted thermal values 562 output by the forward model 546 may correspond and may be compared to one or more actual, measured thermal values 566, such as a measured fluid inlet temperature, measured fluid outlet temperature, measured fluid pressure drop, etc. This may facilitate calibrating, tuning, or training the thermal model 525, as described herein. The predicted thermal values 562 may include any other value that may be predicted by the forward model 546 consistent with that described herein. In this way, the forward model 546 may characterize the thermal behavior of the ground heat exchanger 510 in order to predict one or more observable values of the thermal system 500.

As mentioned, the thermal model 525 may include an inverted model 548. The inverted model 548 may facilitate estimating or predicting one or more of the parameters upon which the forward model 546 is based. In this way, the inverted model 548 may be an inversion or a reversal of the forward model 546. For example, the forward model 546 may predict, based on the model parameters, one or more values of the thermal system 500, and the inverted model 548 may facilitate finding the set of model parameters (e.g., in particular borefield parameters) that result in predicted values that best match actual measured values of the thermal system 500.

For example, as mentioned, the forward model 546 may determine one or more predicted thermal values 562 associated with the thermal system 500 based on a set of initial borefield parameters 564 (among other factors). As described, the data manager 522 may receive sensor data 538 including the measured thermal values 566. In some embodiments, the inverted model 548 compares the predicted thermal values 562 to the measured thermal values 566. For example, the inverted model 548 may include or may define an objective function or cost function that quantifies a target difference between one or more of the predicted thermal values 562 and the measured thermal values 566 for the set of parameters used by the forward model 546 (e.g., used for a given iteration performed by the forward model). In some embodiments, the inverted model 548 finds the set of parameters that minimizes this target difference. For example, the inverted model 548 may iteratively adjust or modify one or more (or all) of the initial borefield parameters 564 in order to iteratively change or modify the predicted thermal values 562 that the forward model 546 outputs.

In some embodiments, the inverted model 548 includes or defines an optimization algorithm or engine in order to find the best-fit values for the initial borefield parameters. For example, the inverted model 548 may try and/or modify different combinations of the initial borefield parameters 564 to yield a sufficient or desirable target difference. In some embodiments, the inverted model 548 functions iteratively in this way until a convergence occurs for the target difference. For example, the inverted model 548 may iterate until the target difference is within a predetermined threshold, such as substantially 0. In another example, the inverted model 548 may iterate until a change in the target difference is within a predetermined threshold (e.g., for a threshold quantity of consecutive iterations). In another example, the inverted model 548 may iterate until a minimum (or least) target difference is found, such as by iterating through a predetermined quantity of (or all) iterations.

In this way, the inverted model 548 may iteratively generate the predicted thermal values 562 and compare those values to the measured thermal values 566 in order to determine a set of best-fit borefield parameters. The inverted model 548 may output these best-fit parameters as predicted borefield parameters 560. For example, the predicted borefield parameters 560 may include a ground thermal conductivity (k) and a grout thermal conductivity (kg). The predicted borefield parameters 560 may include an average temperature ($T_0$) of the ground 509 and/or a current temperature (T) of the ground in one or more locations of the ground in the neighborhood of the borefield. The average temperature $T_0$ may be an average far-field or undisturbed ground temperature. The borefield parameters 560 may be associated with one or more depths within the ground 509, or may be associated with the ground heat exchanger 510 generally (e.g., an average). In this way, the predicted borefield parameters 560 may represent an inference of one or more properties or parameters of the ground heat exchanger 510. In some embodiments, determining (e.g., measuring) an actual value of one or more of the predicted borefield parameters 560 may not be possible, may be prohibitively difficult or not feasible, or may be cumbersome in practice. By inferring the predicted borefield parameters 560 in this way, the thermal model 525 may facilitate understanding a state, change, condition, etc., of one or more of the thermal properties of the thermal system 500 which may otherwise not be known. As discussed herein, generating the predicted borefield parameters 560 may facilitate monitoring, analyzing, and/or controlling one or more aspects of the thermal system 500.

The thermal model 525 may be implemented in order to determine the predicted borefield parameters 560. In some embodiments, the thermal model 525 iteratively and/or continuously determines the predicted borefield parameters 560. For example, the thermal model 525 may update the predicted borefield parameters 560 one or more times over a predetermined time interval. For instance, the thermal model 525 may receive the inputs (e.g., thermal flux input 556 and/or flow rate input 558) at discrete time intervals such as every 1 minute, 2 minutes, 3 minutes, 4 minutes, 5 minutes, or up to every 1 hour, 2 hours, 3 hours, or more. The inputs may include an actual measured value and/or may include a statistical value such as an average, mean, median, mode, maximum, minimum, etc., calculated over several time intervals. In this way, the thermal model 525 may receive the inputs as live or real-time data inputs. The thermal model 525 may accordingly update the predicted borefield parameters 560 in real time based on the live data inputs. In this way, the thermal model 525 may facilitate a real-time estimation or inference of the predicted borefield parameters 560 to simulate changes in the thermal response over predetermined time intervals based on heat extracted or injected by the GSHP 502.

The thermal model 525 functioning based on the inputs and parameters discussed above, in this way, may facilitate determining the predicted borefield parameters 560 during operation of the thermal system 500 and/or the GSHP 502. For example, the borefield design parameters 552 and the completion design parameters 554 may include static values that may be known or calculated, for example, based on the design, construction, etc., of the thermal system 500. Additionally, the thermal flux input 556 and the flowrate input 558 may include values and/or may be calculated from values that are received and/or measured by the data manager 522 during operation of the thermal system 500, such as with temperature sensors, flow sensors, pressure sensors, etc. The predicted borefield parameters 560 may accordingly be determined during operation of the thermal system 500 based on this information that is known and/or collected during operations. In this way, the thermal management system 520 may provide the features and functionalities discussed herein without having to put the thermal system 500 offline.

Figure 15:
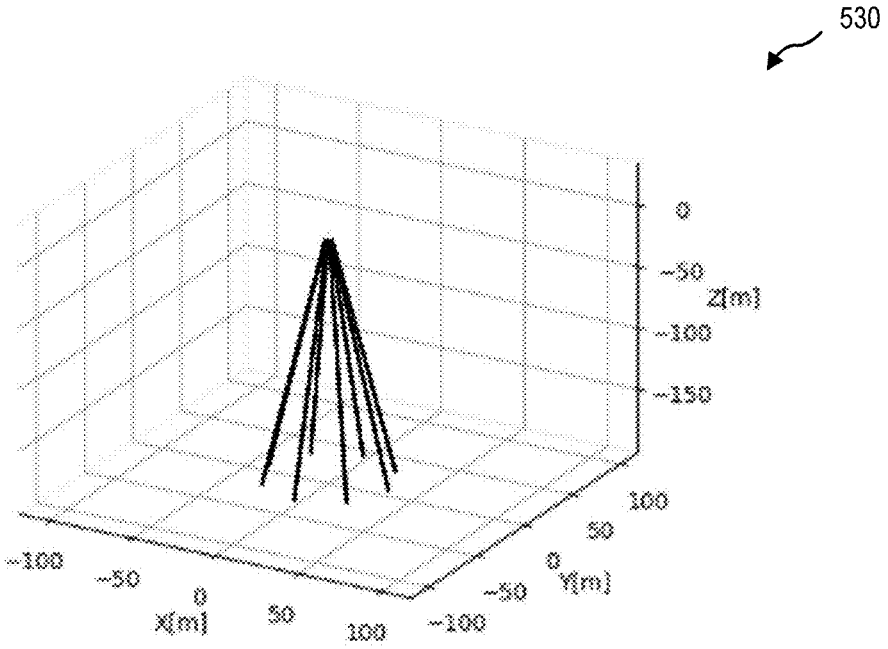
FIG. 15 illustrates an example of a digital twin of a borefield, according to at least one embodiment of the present disclosure.
Figure 15:
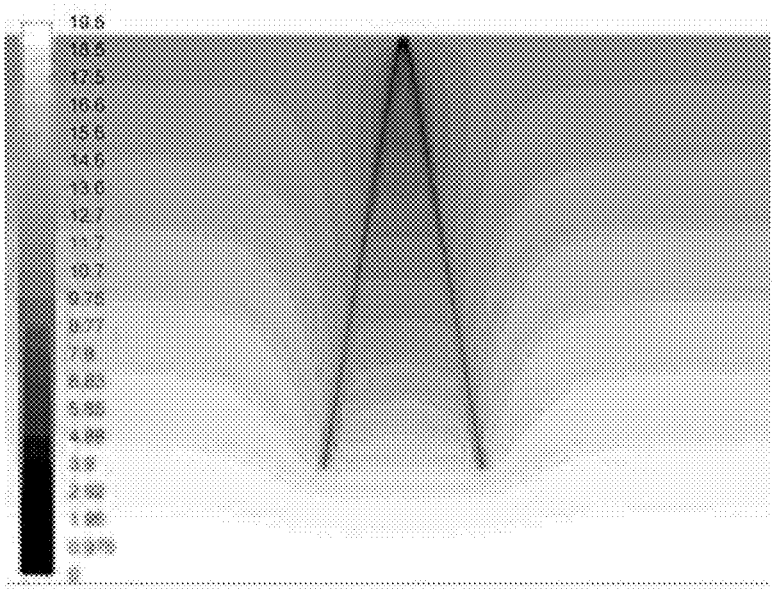

In some embodiments, the thermal management system utilizes the predicted borefield parameters 560 to generate and/or implement a digital twin 530, as shown in FIG. 15. The digital twin 530 may be a digital representation of one or more aspects of the ground heat exchanger 510 and/or the borefield 508. For example, based on the predicted borefield parameters 560, the digital twin may infer one or more other parameters, properties, and/or states of the thermal system 500.

In some embodiments, the digital twin 530 indicates a temperature of the borefield 508 and/or the ground 509 at one or more locations. For example, given the known geometry and configuration of the ground heat exchanger 510, as well as the flow measurements of the thermal fluid, and by incorporating the thermal properties of the ground 509 (e.g., the predicted borefield parameters 560) the model engine 524 may generate a detailed temperature map of the borefield 508. The digital twin 530 may indicate one or more temperatures with respect to a (e.g., 2- or 3-dimensional) spatial coordinate. For example, the digital twin 530 may indicate a 2- or 3-dimensional grid consisting of individual cells associated with a specific location in the borefield 508. The size and/or quantity of cells may vary depending on a desired level of detail for the digital twin 530. For each cell in the grid, the thermal management system 520 may determine a temperature based on a physical modelling of the heat transfer to that location by implementing heat transfer equations and/or numerical methods (e.g., similar to that used in connection with the forward model 546). The thermal management system 520 may incorporate lithology data for the ground 509, data from thermal response tests, laboratory testing, or any other data such as data from the data storage 528. In some embodiments one or more methods of interpolation are implemented for estimating temperatures at the boundaries of cells of the grid and/or between cells. In this way, a continuous temperature field may be generated for an area of interest (or all of) the borefield 508 via the digital twin 530.

In some embodiments, the thermal management system 520 generates a plot, or a visual representation of the digital twin 530. For example, the thermal management system 520 may implement color mapping or shading to represent different temperatures of the temperature field in order to generate a 2- or 3-dimensional temperature map of the borefield 508. In some embodiments, the thermal management system 520 displays the digital twin 530 via a graphical user interface. In this way, the digital twin 530 may be visually represented and presented in order that a user may analyze and/or interpret the inferred temperatures of the borefield 508.

In some embodiments, the data manager 522 receives user input. The data manager 522 may receive the user input, for example, via any of the client devices 512 and/or server devices 514. Any of the data described herein may be input or augmented via the user input. For example, in some instances, some or all of the sensor data may be received by the data manager 522 as user input. In some instances, some or all of the inferred data may be received by the data manager 522 as user input. As will be described herein, one or more functions or features of the thermal management system 520 may be facilitated by receiving user input. The data manager 522 may save and/or store any of the data it receives to the data storage 528.

As discussed above, the thermal system 500 may be configured (e.g., configuration A, configuration B, etc.) such that the GSHP 502 is oversized with respect to the borefield 508. Operating the GSHP 502 in this way may cause the fluid inlet temperature to exceed the temperature threshold. For example, the conventional GSHPs discussed herein are sized such that the fluid inlet temperature reaches the temperature threshold only after nearly 25 years, even when operating at full capacity. In contrast, the oversized GSHP 502 of the thermal system 500 (e.g., at full capacity) may cause the fluid inlet temperature to reach or exceed the temperature threshold much earlier than 25 years, such as within 2 years, within 1 year, or immediately.

In order to facilitate implementing the oversized GSHP 502, the thermal management system 520 includes a comparison engine 524 and a thermal power controller 526. The comparison engine 524 may facilitate monitoring a temperature associated with the borefield, such as the fluid inlet temperature of the thermal system 500 or the inferred ground temperature, against the more temperature threshold, and the thermal power controller 526 may control an operation of the GSHP 502 in order to control a thermal output of the GSHP 502. For example, the comparison engine 524 may monitor the fluid inlet temperature received by the data manager 522. In some embodiments, the comparison engine 524 performs one or more (e.g., statistical) calculations on the fluid inlet temperature, such as to find a mean, median, average, minimum, maximum, etc., over a time interval. In some embodiments, the comparison engine 524 determines a trend and/or predicts a future value for the fluid inlet temperature. The comparison engine 524 may compare values of the temperature related to the ground temperature to an associated temperature threshold. For example, the comparison engine 524 may compare the inlet temperature to a temperature threshold lower limit of −2° C. In another example, the comparison engine 524 may compare the fluid inlet temperature to a temperature threshold upper limit of 40° C.

Based on the comparison, the comparison engine 524 may generate and send a signal to the thermal power controller 526. For example, if the temperature associated with the borefield (such as the inlet temperature) is greater than −2° C., the comparison engine 524 may indicate to the thermal power controller 526 to continue operation of the GSHP 502 (e.g., at full capacity). In another example, if the temperature associated with the borefield (such as the inlet temperature) exceeds −2° C., the comparison engine 524 may indicate to the thermal power controller 526 to adjust, or stop, the thermal power output of the GSHP 502. In another example, as the inlet temperature approaches or trends towards −2° C., the comparison engine 524 may indicate to the thermal power controller 526 to throttle the GSHP 502 or to reduce a thermal power output of the GSHP 502 to prevent the inlet temperature from falling below −2° C. In another example, the comparison engine may predict or forecast a future value of the inlet temperature, and the thermal power controller 526 may accordingly control the thermal power output of the GSHP 502 based on the future prediction. In some embodiments, the thermal power output of the GSHP 502 is controlled to maintain the inlet temperature at a desired setpoint, such as at or near the temperature threshold. The comparison engine 524 in connection with the thermal power controller 526 may implemented a feedback control loop to adjust the thermal power output of the GSHP 502 and/or to control the fluid inlet temperature of the thermal system 500.

The thermal power controller 526 may control the thermal power output of the GSHP 502 in a variety of ways. For example, in some embodiments, the thermal power controller 526 adjusts the duty cycle of a compressor and/or modulates the speed of a variable speed compressor of the GSHP 502. In some embodiments, the GSHP 502 includes multiple stages, and the thermal power controller 526 facilitates operating one or more of the stages in order to run the GSHP 502 at different capacities. In some embodiments, the thermal power controller 526 adjusts one or more modulating valves for controlling the flow rate of thermal fluid associated with the GSHP 502. In some embodiments, the thermal power controller 526 adjusts one or more temperature setpoints and/or schedules for the facility 506 to change a thermal load demanded by the facility 506. In some embodiments, the thermal power controller 526 implements load shifting techniques by, for example, charging a thermal storage during non-peak hours, and supplementing the GSHP 502 with the thermal storage in order to shift some or all of the thermal load from the GSHP 502. The thermal power controller 526 may implement control algorithms in order to optimize the operation of the GSHP 502 (or any other component of the thermal system 500) based on load requirements and predictions, occupancy patterns, weather forecasts, etc. The thermal power controller 526 may operate in this way to control the GSHP 502 for both heating and cooling conditions. In this way, the thermal power controller 526 may implement one or more (and combinations) of techniques for adjusting the thermal power generated by the GSHP 502. The thermal power generated by the GSHP 502 may correspond directly with and/or may influence the fluid inlet temperature of the thermal system 500 based on an amount of energy extracted or injected into the ground 509.

Figures 1, 9:
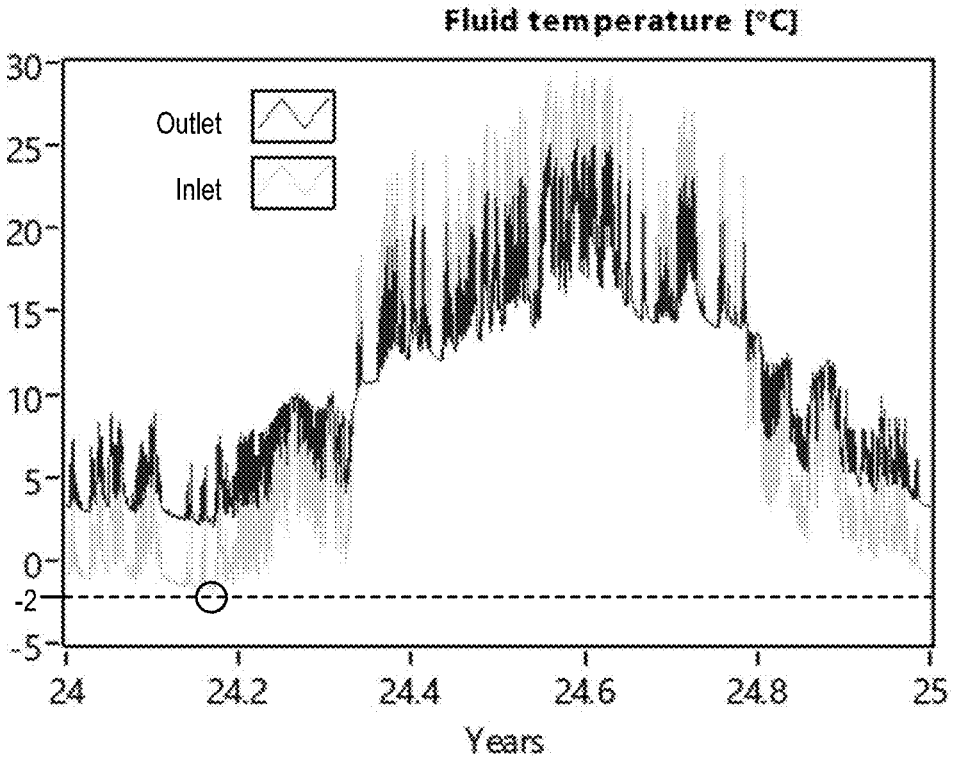
Figures 2, 9:
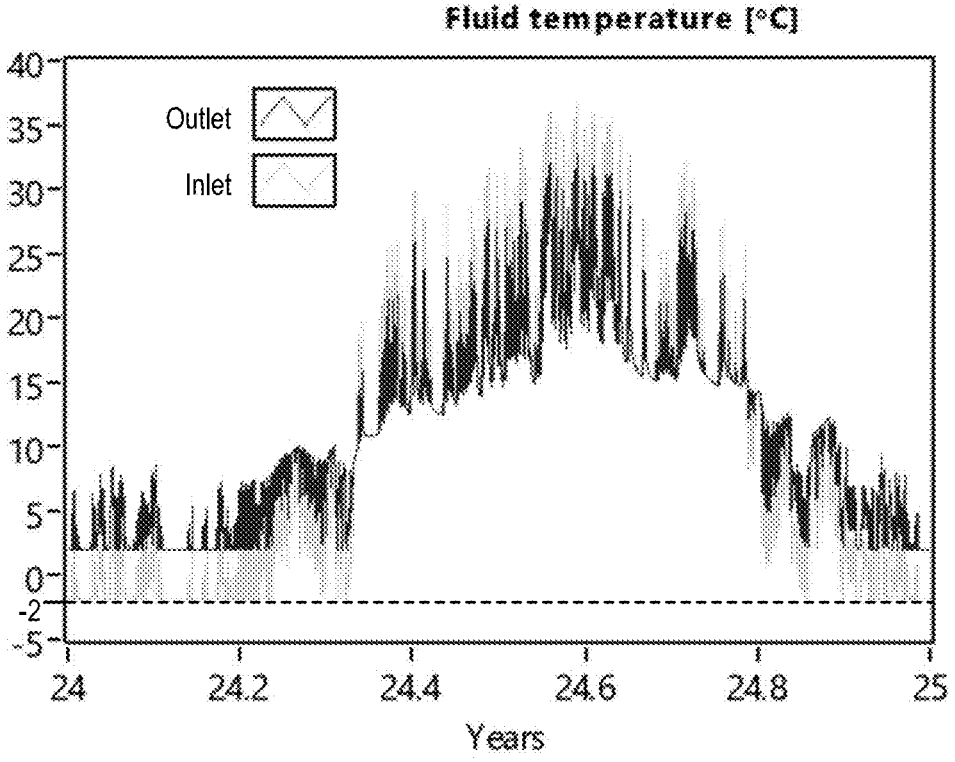

FIG. 9-1 shows the fluid inlet and outlet temperatures for the thermal fluid flowing through the ground heat exchanger 110 of the conventional thermal system 100 over the course of a 25$^{th}$ year of operation of the thermal system 100. FIG. 9-2 similarly shows the fluid inlet and outlet temperatures for the thermal fluid of the thermal system 500, which implements an oversized heat pump (e.g., configuration A or configuration B) as described herein. As mentioned above, the thermal management system 520 may regulate the thermal output of the GSHP 502 based on the fluid inlet temperature. The GSHP 502 may operate at a full capacity (e.g., when activated) until the fluid inlet temperature is at or near the fluid inlet temperature, in which case the thermal power output of the GSHP 502 is modulated or controlled to maintain the fluid inlet temperature above the temperature threshold. As shown in FIG. 9-2, the fluid inlet temperature never falls below the temperature threshold of −2° C. While only the 25$^{th}$ year is shown, this pattern may be typical for each year of operation of the thermal system 500. In contrast, as shown in FIG. 9-1, the fluid inlet temperature of the conventional thermal system 100 reaches the temperature threshold of −2° C. just once, by sizing design, during the 25$^{th}$ year, despite the GSHP 102 only operating at full capacity (e.g., no controlling of thermal power). In this way, the GSHP 502 may be oversized compared to the GSHP 102, but the thermal system 500 may still operate within the fluid inlet temperature threshold of −2° C. by limiting, at times, the thermal power capacity of the GSHP 502.

Figure 10:
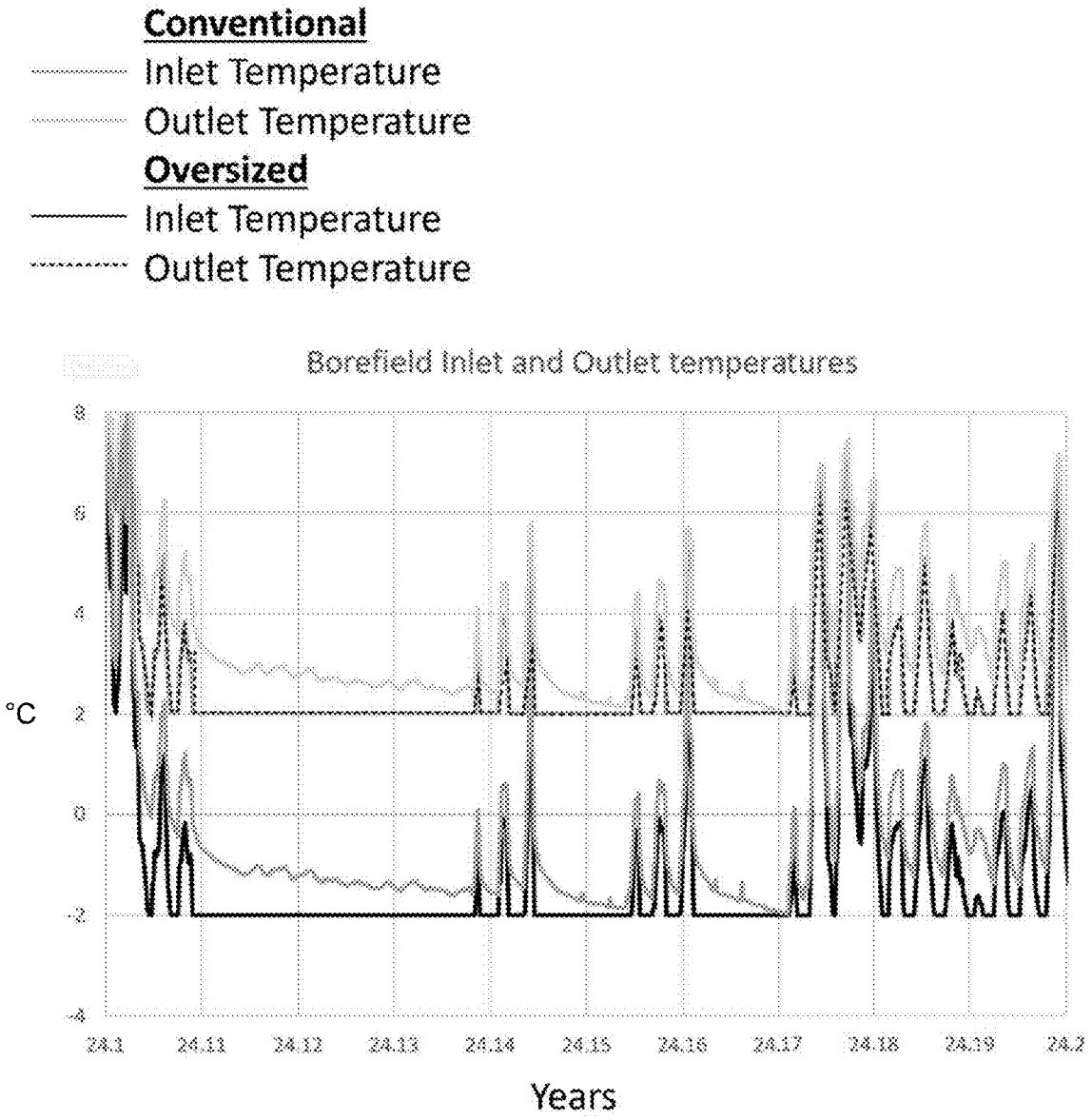
FIG. 10 illustrates the fluid inlet and outlet temperatures for both the conventional thermal system of FIG. 1 and the thermal system of FIG. 5.

FIG. 10 similarly illustrates the fluid inlet and outlet temperatures for both the conventional thermal system 100 and the thermal system 500 over the course of about a month (e.g., February) of the 25$^{th}$ year. As shown, when the facility 506 calls for heating, the GSHP 502 operates such that the fluid inlet temperature of the thermal system 500 is at or near the temperature threshold (e.g., −2° C.). In contrast, the conventional thermal system 100 operates such that, even at full capacity, the GSHP 102 does not operate with a fluid inlet temperature of −2° C. until sometime in the 25$^{th}$ year (e.g., about 24.17 years). In both cases, supplemental thermal devices may be operated to supplement the heat pump where the heat pump alone cannot fulfill the needs of the facility. However, the thermal system 500 operating at lower fluid temperatures (e.g., at the temperature threshold) than the conventional thermal system 100 may correspond with the thermal system 500 extracting more heat energy from the ground, and accordingly may allow for operating the supplemental thermal devices to a lesser degree. In this way the thermal system 500 may provide performance benefits over that of the conventional thermal system 100, while also avoiding detrimental ground conditions (e.g., freezing temperatures).

While the thermal system 500 has been described primarily with respect to a lower temperature threshold, such as −2° C., and maintaining the inlet temperature above the lower temperature threshold during heating, it should be understood that the thermal system 500, and the thermal management system 520, may be configured similarly for providing cooling. For example, the thermal management system 520 may control the thermal power of the GSHP 502 to maintain the inlet temperature below an upper temperature threshold, such as 40° C. during cooling. In this way, the features and functionalities of the thermal system 500 may apply equally to heating conditions and cooling conditions (or both).

Figures 1, 11:
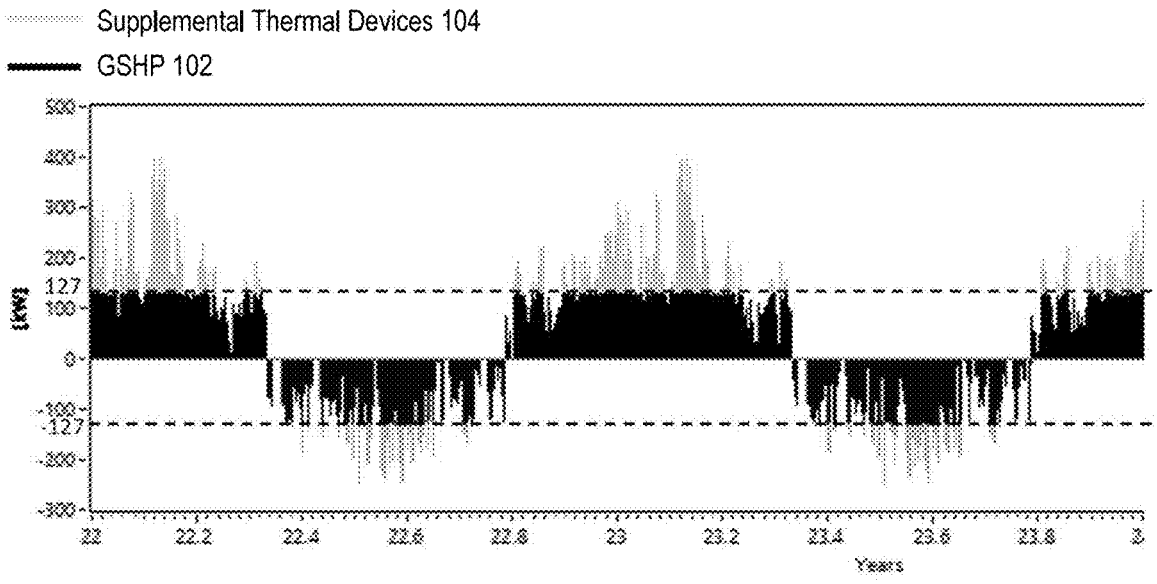
Figures 2, 11:
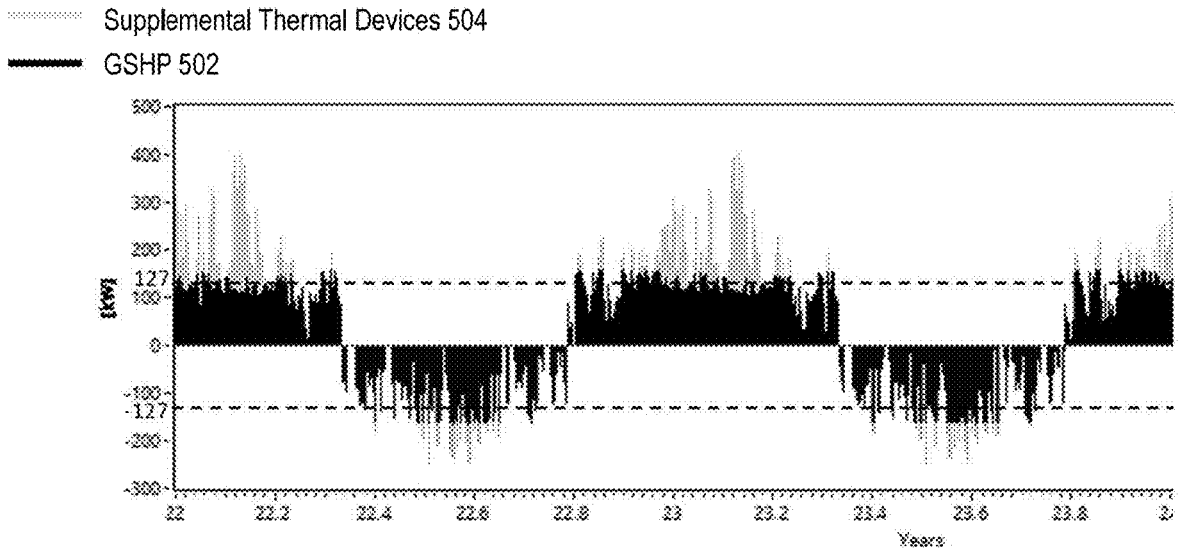

The GSHP 502 being oversized in this way, and being actively controlled based on a temperature relative to the ground temperature, such as the fluid inlet temperature, may result in an increased amount of energy extracted from (or injected to) the ground 509, while still operating within the operational (or regulatory) temperature thresholds. FIG. 11-1 illustrates the thermal power provided by the conventional thermal system 100, including both the GSHP 102 and the supplemental thermal devices 104, over the course of two years. FIG. 11-2 similarly illustrates the thermal power provided by the thermal system 500, including both the GSHP 502 and the supplemental thermal devices 504, over the course of the same two years. As shown in FIG. 11-1, the thermal power provided by the GSHP 102 has a maximum of about 127 kW, based on the conventional sizing and configuration of the GSHP 102 as described above. The GSHP 102 may operate in this way without the fluid inlet temperature reaching the temperature threshold until nearly 25 years, as described in connection with FIGS. 9-1 to 10. In contrast, as shown in FIG. 11-2, the thermal power output of the GSHP 502 is controlled and/or modulated in order to maintain the fluid inlet temperature at or above the temperature threshold. This results in the GSHP 502 extracting more thermal energy from the ground 509 as compared to the conventional thermal system 100. A similar effect can be seen for the cooling provided by the respective thermal systems.

In this way, the thermal system 500 may generate more thermal power by actively controlling the GSHP 502 to comply with the fluid inlet temperature and/or ground temperature thresholds, in contrast to the conventional thermal system 100, which permanently limits the power capacity, and consequently the thermal power outlet, to meet the temperature threshold requirements.

Figure 12:
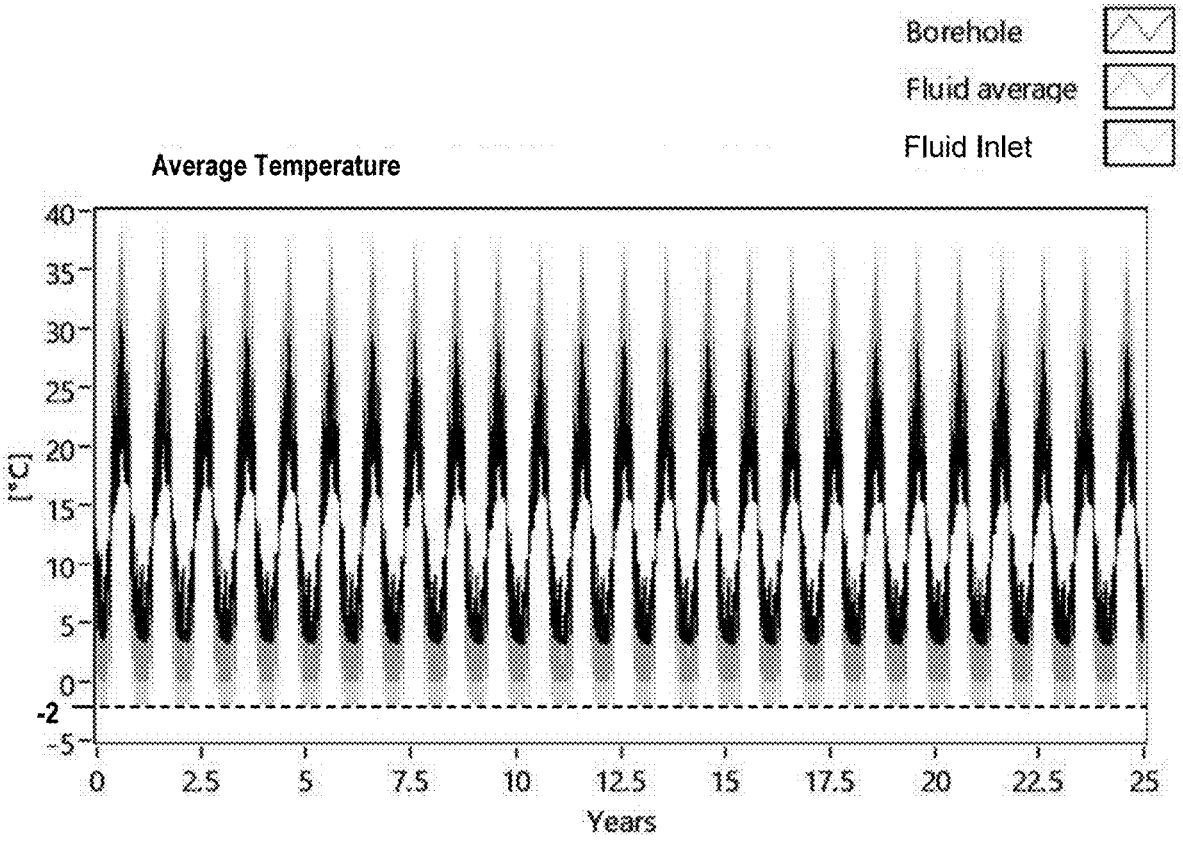
FIG. 12 illustrates example temperatures over time for the borefield of the thermal system of FIG. 5.

FIG. 12 illustrates example temperatures over time for the borefield 508. For example, FIG. 12 illustrates the fluid inlet temperature, as well as an average fluid temperature between the inlet and outlet fluid temperatures. Additionally, FIG. 12 illustrates a borehole temperature, which may be a temperature of an associated borehole, such as temperature at a specific location, or an average of one or more temperatures. As shown, the fluid inlet temperature may reach the temperature threshold of −2° C. almost immediately (e.g., within the first year), but the active modulation of the thermal power of the GSHP 502 may maintain the fluid inlet temperature (e.g., during the heating months) at or above the temperature threshold for the duration of the 25-year period (and beyond). Similarly, the borehole temperature may fall below 5° C. within the first year and may generally maintain at that temperature (e.g., during the heating months) for the duration of the 25 years. This may be in contrast to that shown and discussed above in connection with FIG. 4, in which the fluid inlet and borehole temperatures decrease on average over time until they reach the threshold temperature(s) near the 25$^{th}$ year.

Figures 1, 13:
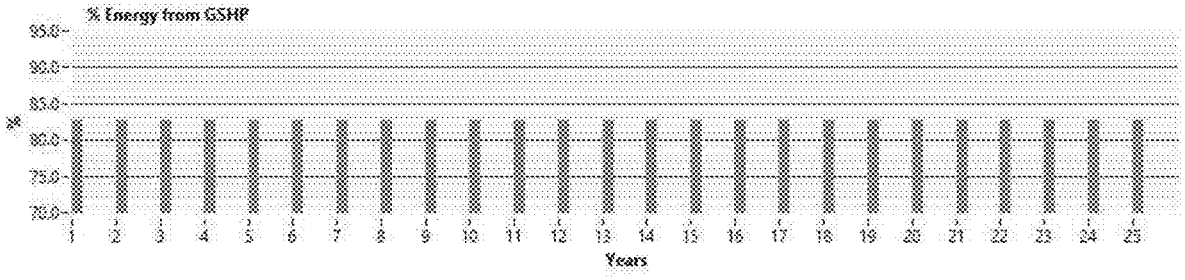
Figures 2, 13:
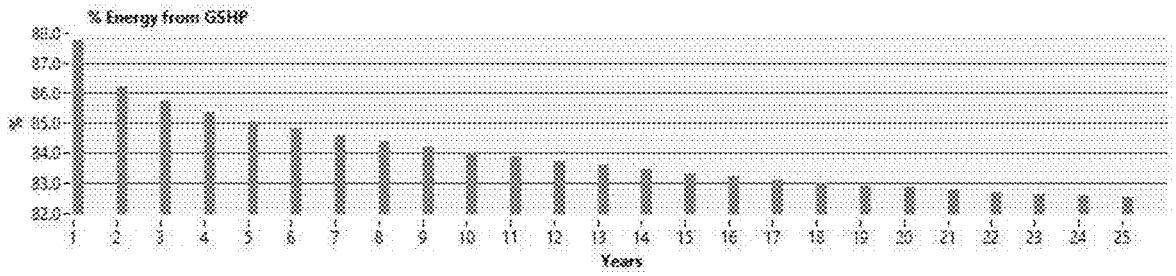

FIG. 13-1 illustrates the thermal energy produced by the GSHP 102 as a percentage of the total thermal energy per year of the thermal system 100 over the course of 25 years. Similarly, FIG. 13-2 illustrates the thermal energy produced by the GSHP 502 as a percentage of the total thermal energy per year of the thermal system 500 over the course of the same 25 years. As shown, the thermal power output by the GSHP 502 may not be constant over the entire 25-year period. For example, the coverage of the GSHP 502 may be higher (e.g., about 88%) during the initial years and may converge over time toward a lower value (e.g., about 82.5%). In contrast, the coverage of the GSHP 102 may be relatively constant (e.g., about 83%) for the entire duration of the 25-years. While the relative generation of the GSHP 502 may eventually converge to a lower value than that of the GSHP 102, the increased amount of thermal energy achieved during the earlier years may offset the slight losses (comparative to the GSHP 102) during the later years such that the average coverage over the useful lifespan of the thermal system 500 (e.g., 25 years) may be greater for the GSHP 102.

The GSHP 502 being oversized in a variety of ways with respect to the borefield 508, which may provide specific benefits in connection with the features and functionalities of the thermal system 500 discussed herein. For example, as mentioned above, the thermal system 500 may be configured with configuration A or configuration B (e.g., of FIG. 6), or other configurations, and combinations thereof. FIG. 14 illustrates example metrics associated with a thermal system configured in the conventional configuration, configuration A, and configuration B.

In accordance with configuration A, the GSHP 502*a* may have a thermal power capacity that is the same or similar to (or even somewhat greater) than that of the GSHP 102. Notably, however, is that the borefield 508*a* for configuration A may be smaller (e.g., have a shorter total drilled length) in relation to the borefield 108 of the conventional configuration. By implementing the techniques described herein to actively control the GSHP 502*a* based on the fluid inlet temperature, the GSHP 502*a* may provide the same heating coverage as the GSHP 102, but may do so with a smaller overall borefield. As shown in FIG. 14, in some embodiments, the GSHP 502*a* additionally achieves increased thermal performance for cooling over that of the GSHP 102, even with a smaller borefield. Thus, configuration A may provide benefits such as reducing the initial burden and/or cost of installing and constructing the thermal system 500, reducing the maintenance and/or upkeep of the ground heat exchanger 510, reducing the amount of thermal fluid to circulate through the ground heat exchanger 510, and facilitating implementation of the ground heat exchanger 510 in a smaller area. In this way, the GSHP 502*a* of configuration A may provide increased performance despite having a proportionately smaller borefield. The example graphs, plots, charts, values, metrics, and/or parameters shown and discussed in connection with FIGS. 9-1 to 13-2 may be applicable to the thermal system 500 implemented with configuration A as described. However, similar benefits may be achieved (e.g., to a greater effect) through implementation of configuration B.

In accordance with configuration B, the borefield 508*b* may have a same or similar size to that of the borefield 108, but the GSHP 502*b* may have a significantly larger thermal capacity (e.g., 30% larger) than that of the GSHP 102. By implementing the techniques described herein to actively control the GSHP 502*b* based on the fluid inlet temperature, the GSHP 502*b* may provide more heating coverage than the GSHP 102 from substantially the same borefield. As shown in FIG. 14, in some embodiments the GSHP 502*b* additionally achieves increased thermal performance for cooling over that of the GSHP 102 to an even greater degree. Thus, configuration B may provide benefits such as fulfilling more of the thermal load of the facility 506 with energy- and cost-efficient heating/cooling means, increasing the total (e.g., peak) thermal power output of the thermal system 500, reducing the required capacity of the supplemental thermal device 504, and reducing the CO2 emissions of the thermal system 500, all without the need for a larger borefield.

The thermal system 500 has been primarily described with respect to controlling the GSHP 502 based on a temperature threshold for a temperature associated with the borefield intended to prevent the ground 509 from freezing, such as −2° C. In some embodiments, a temperature threshold is implemented to facilitate preventing the thermal fluid from freezing. For example, the temperature threshold may be 2° C., 3° C., 4° C., 5° C., or any other value. Preventing freezing of the thermal fluid with the temperature threshold in this way may prevent damage, inefficiencies, and/or disruptions of an operation of the thermal system 500. Additionally, maintaining the thermal fluid above freezing in this way may facilitate utilizing water as the thermal fluid. For example, in many cases, an antifreeze additive such as glycol or brine may be mixed with the thermal fluid (e.g., water) in order to lower a freezing point of the thermal fluid and facilitate implementing the thermal fluid at lower temperatures. These additives used in the thermal fluid mixtures may be expensive, especially when considering the volume of thermal fluid in circulation in the thermal system 500 (e.g., including over 4000 linear feet of ground loops 507). Thus, utilizing water as the thermal fluid, and maintaining the fluid inlet temperature above freezing, may eliminate the need for anti-freeze additives which may provide additional cost, material, and/or maintenance savings.

FIG. 15 illustrates an example of a digital twin 530 of the borefield 508. As mentioned above in connection with the data manager 522, the digital twin 530 may be generated by a thermal model which, based on one or more measured values of the thermal system 500, may be trained, calibrated, and validated to accurately predict certain properties of the borefield 508 such as a ground thermal conductivity, a grout thermal conductivity, and/or an average far-field or undisturbed ground temperature. Based on these predicted borefield properties, the thermal model may generate the digital twin 530 to infer the temperature at one or more (or all) locations of the borefield 508. The thermal model may predict the borefield properties and generate the digital twin 530 in real time and during operation of the GSHP 502. In this way, the digital twin 530 may provide a live overview of temperatures within the ground 509.

In some embodiments, the thermal management system 520 controls the thermal system 500 based on the digital twin 530. For example, the thermal management system 520 may monitor the digital twin 530 to determine a minimum temperature of any location in the borefield 508. The thermal management system 520 may modulate the thermal power output of the GSHP 502 to maintain the borefield 508 above freezing (e.g., 0° C.) at all locations. For example, in some cases the fluid inlet temperature may be maintained above the temperature threshold (e.g., −2° C.) as a proxy for preventing the ground 509 from freezing. However, in some instances, the ground 509 may nevertheless freeze despite the fluid inlet temperature being above the temperature threshold. Thus, the digital twin 530 may facilitate controlling the thermal output of the GSHP 502 based on actual (e.g., inferred) minimum ground temperature to ensure that the ground 509 does not freeze, for example, instead of relying on the fluid inlet temperature threshold to act as a proxy, which may not always accurately reflect the condition of the ground temperature in one or more locations.

In some embodiments, the thermal management system 520 controls the thermal system 500 based on both the digital twin 530 and the temperature threshold for the inlet temperature. For example, as just mentioned, the thermal management system 520 may regulate the GSHP 502 based on the fluid inlet temperature, but the ground 509 may nevertheless freeze. Similarly, in another example, the ground temperature may remain above freezing, but the fluid inlet temperature may nevertheless fall below −2° C. (e.g., which may violate an inlet temperature threshold). The thermal management system 520 may accordingly control the thermal power output of the GSHP 502 to maintain both the fluid inlet temperature above the temperature threshold, and to maintain the inferred minimum ground temperature of the digital twin 530 above freezing. For example, either temperature metric approaching an associated threshold may cause the thermal management system 520 to adjust (e.g., reduce) the thermal power output of the GSHP 502 to ensure that the temperature(s) do not fall below the associated threshold(s). In this way, the thermal management system 520 may control the thermal system 500 based on both the fluid inlet temperature and the digital twin 530 in order to ensure that the ground 509 does not freeze, while also ensuring compliance with any associated fluid inlet temperature regulations.

Figure 16:
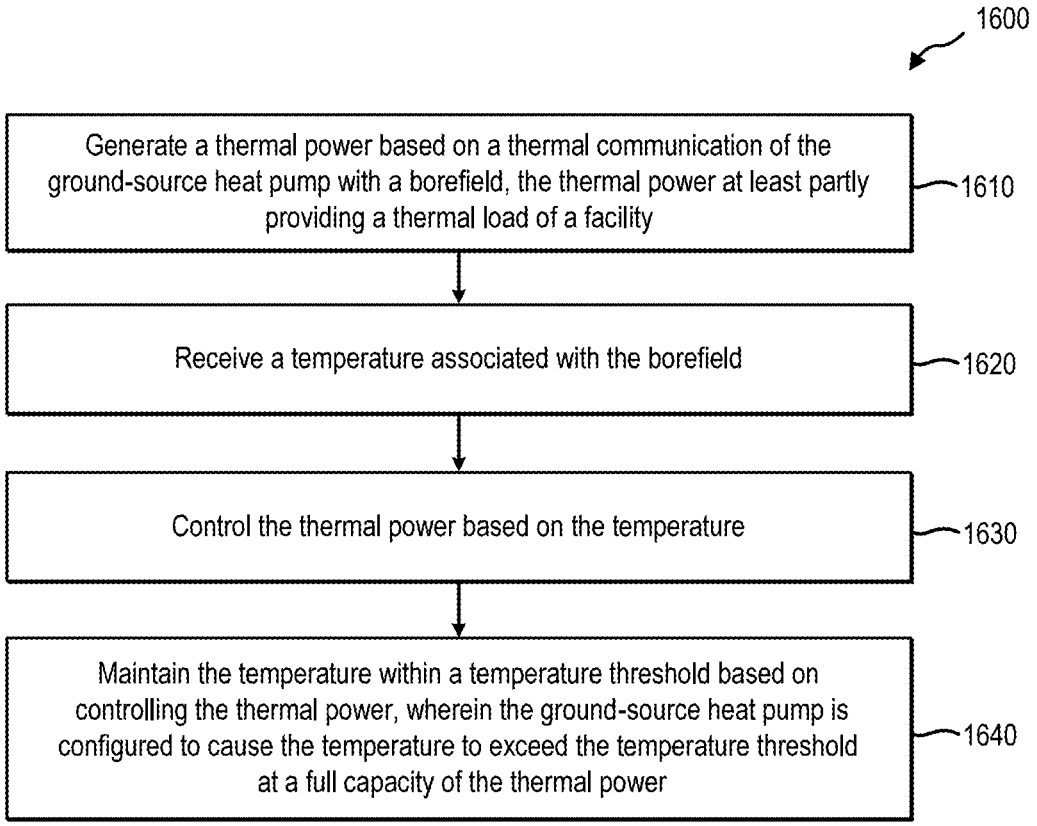
FIG. 16 illustrates a flow diagram for a method of operating a ground-source heat pump as described herein, according to at least one embodiment of the present disclosure.

FIG. 16 is a flow diagram illustrating a method 1600 or a series of acts for operating a GSHP as described herein, according to at least one embodiment of the present disclosure. While FIG. 16 illustrates acts according to one embodiment, alternative embodiments may add to, omit, modify, and/or reorder any of the acts of FIG. 16.

In some embodiments, the method 1600 includes an act 1610 of generating a thermal power based on a thermal communication of the GSHP with a borefield. For example, a thermal fluid may flow between the GSHP and the borefield. The thermal power may at least partly cover a thermal load of a facility. In some embodiments, the thermal power covers at least 80% of a total thermal energy to the facility for heating. In some embodiments, the thermal power covers at least 96% of a total thermal energy from the facility for cooling.

In some embodiments, the method 1600 includes an act 1620 of receiving a temperature associated with the borefield. For example, the temperature may be a fluid inlet temperature of a thermal fluid flowing into the borefield. In another example, the temperature may be a minimum borefield temperature at any point in the borefield. The minimum temperature may be an inferred minimum temperature and may be based on a digital twin of the borefield generated by a thermal model. For example, the thermal model may predict borefield properties by inverting a forward model of the borefield in real time and during operation of the GSHP. The borefield properties may include one or more of a predicted ground thermal conductivity, a predicted grout thermal conductivity, and a predicted far-field ground temperature. The digital twin may be generated based on a borehole geometry for one or more boreholes of the borefield and/or a completion geometry for a completion of the one or more boreholes.

In some embodiments, the method 1600 includes an act 1630 of controlling the thermal power based on the temperature. For example, controlling the thermal power of the GSHP may include controlling a flow rate of the thermal fluid. In another example, controlling the thermal power of the GSHP may include controlling a duty cycle or a speed of a compressor of the GSHP.

In some embodiments, the method 1600 includes an act 1640 of maintaining the temperature within a temperature threshold based on controlling the thermal power, wherein the GSHP is configured to cause the temperature to exceed the temperature threshold at a full capacity of the thermal power. For example, controlling the thermal power of the GSHP may include operating the GSHP at a full capacity of the thermal power until the temperature reaches the temperature threshold, and when the temperature reaches the temperature threshold, throttling the ground-source heat pump to prevent the temperature from surpassing the temperature threshold. In another example, controlling the thermal power of the GSHP may include operating the GSHP at less than full capacity of the thermal power when the temperature reaches the temperature threshold. In some embodiments, the temperature threshold is a temperature threshold of the fluid inlet temperature. For example, the temperature threshold may have a lower limit of −2° C. In some embodiments, the temperature threshold is a temperature threshold of the minimum borefield temperature inferred by the digital twin. For example, the temperature threshold may include a lower limit above 0° C. In some embodiments, the GSHP is configured to cause the temperature to fall below the temperature threshold at a full capacity of the thermal power based on the GSHP being oversized with respect to the borefield.

Figure 17:
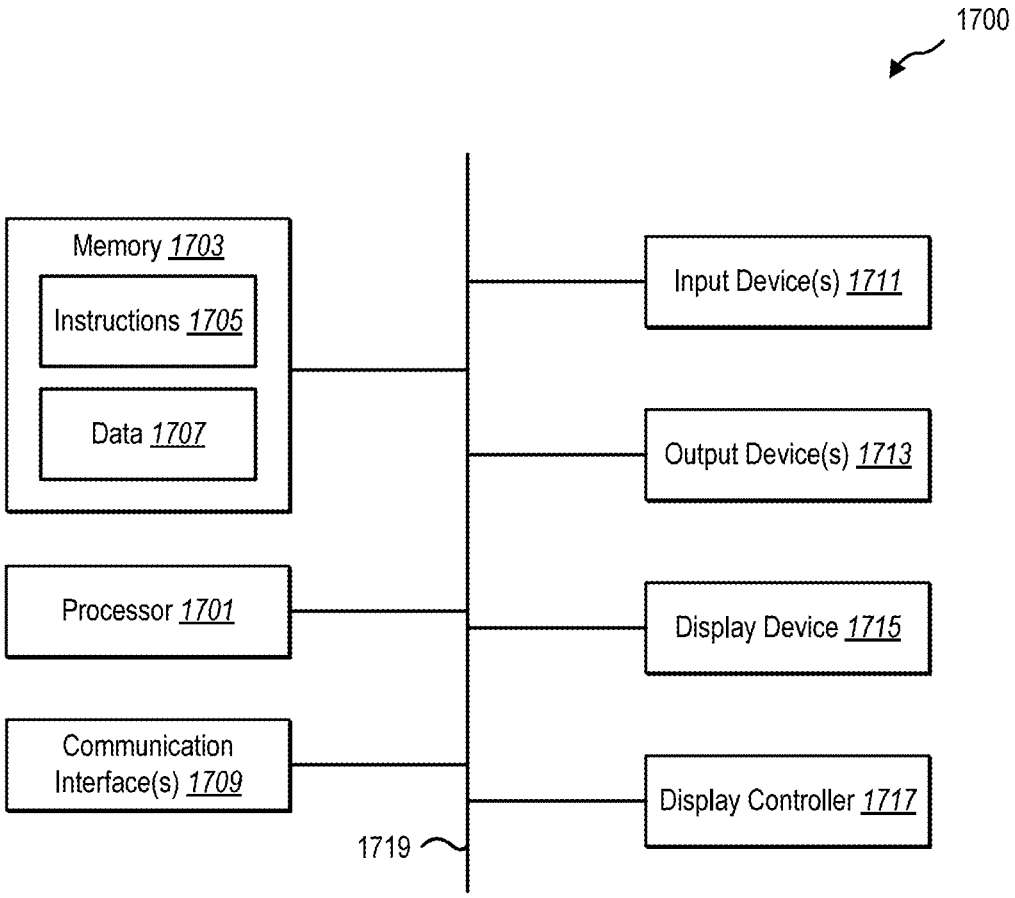
FIG. 17 illustrates certain components that may be included within a computer system.

Turning now to FIG. 17, this figure illustrates certain components that may be included within a computer system 1700. One or more computer systems 1700 may be used to implement the various devices, components, and systems described herein.

The computer system 1700 includes a processor 1701. The processor 1701 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1701 may be referred to as a central processing unit (CPU). Although just a single processor 1701 is shown in the computer system 1700 of FIG. 17, in an alternative configuration, a combination of processors (e.g., an ARM and DSP) could be used.

The computer system 1700 also includes memory 1703 in electronic communication with the processor 1701. The memory 1703 may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitation, an embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer-readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HD DVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored in software, hardware, firmware, or combinations thereof.

Instructions 1705 and data 1707 may be stored in the memory 1703. The instructions 1705 may be executable by the processor 1701 to implement some or all of the functionality disclosed herein. Executing the instructions 1705 may involve the use of the data 1707 that is stored in the memory 1703. Any of the various examples of modules and components described herein may be implemented, partially or wholly, as instructions 1705 stored in memory 1703 and executed by the processor 1701. Any of the various examples of data described herein may be among the data 1707 that is stored in memory 1703 and used during execution of the instructions 1705 by the processor 1701.

A computer system 1700 may also include one or more communication interfaces 1709 for communicating with other electronic devices. The communication interface(s) 1709 may be based on wired communication technology, wireless communication technology, or both. Some examples of communication interfaces 1709 include a Universal Serial Bus (USB), an Ethernet adapter, a wireless adapter that operates in accordance with an Institute of Electrical and Electronics Engineers (IEEE) 802.17 wireless communication protocol, a Bluetooth® wireless communication adapter, and an infrared (IR) communication port.

The communication interfaces 1709 may connect the computer system 1700 to a network. A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system 1700 may also include one or more input devices 1711 and one or more output devices 1713. Some examples of input devices 1711 include a keyboard, mouse, microphone, remote control device, button, joystick, trackball, touchpad, and lightpen. Some examples of output devices 1713 include a speaker and a printer. One specific type of output device that is typically included in a computer system 1700 is a display device 1715. Display devices 1715 used with embodiments disclosed herein may utilize any suitable image projection technology, such as liquid crystal display (LCD), light-emitting diode (LED), gas plasma, electroluminescence, or the like. A display controller 1717 may also be provided, for converting data 1707 stored in the memory 1703 into text, graphics, and/or moving images (as appropriate) shown on the display device 1715.

The various components of the computer system 1700 may be coupled together by one or more buses, which may include a power bus, a control signal bus, a status signal bus, a data bus, etc. For the sake of clarity, the various buses are illustrated in FIG. 17 as a bus system 1719.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

INDUSTRIAL APPLICABILITY

In some embodiments, a conventional thermal system may typically include a ground-source heat pump (GSHP). The GSHP may be in thermal communication with a ground (or borehole) heat exchanger. The ground heat exchanger may include a borefield having one or more boreholes within a volume of ground defining the borefield. One or more ground loops may be positioned within the one or more boreholes, and the boreholes may be at least partially filled with a grout, for example, to maintain the ground loops in place and to facilitate heat transfer between the ground loops and the ground. The ground loops may have a fluid inlet and a fluid outlet but may have any configuration in the wellbore, for instance coaxial or U-shaped. The ground loops may be operatively coupled to the GSHP, and a thermal fluid may flow through the ground loops to facilitate the thermal communication between the ground heat exchanger and the GSHP.

The GSHP may typically be in thermal communication with a facility heat exchanger of a facility. The GSHP may include a compressor and an evaporator (e.g., expansion valve) for implementing a refrigerant cycle between a heat exchanger receiving the refrigerant and the thermal fluid and the facility heat exchanger, to transfer heat from the facility to the borefield—through the thermal fluid—for cooling the facility, as well as to transfer heat from the borefield to the facility to heat the facility. In this way, the GSHP may be a geothermal heat pump for leveraging the thermal properties and conditions within the ground to provide energy- and cost-efficient heating and cooling to the facility.

The conventional thermal system may typically include one or more supplemental thermal devices for providing heating and/or cooling to the facility. For example, the supplemental thermal devices may include one or more heating devices such as a boiler, furnace, or any other heating device. The supplemental thermal devices may also include one or more cooling devices such as a chiller, cooling tower, fin-fan cooler, or any other cooling device. The supplemental thermal devices may be configured to provide heating and/or cooling to the facility in addition to or in parallel with the GSHP. For example, the GSHP and ground heat exchanger may be dimensioned and configured to at least partly cover the thermal load of the facility, and the remaining portion may be covered by the supplemental thermal devices. This split nature of the heating and cooling may typically be dictated by a cost function analysis which balances the energy and cost savings of the GSHP and ground heat exchanger with the associated initial installation and operational expenses.

Designing and implementing the thermal system may typically involve determining the thermal load requirements of the facility. The thermal loading may be observed and/or simulated for the facility. In some embodiments, the peak thermal load of the facility 106 can be determined to be approximately 400 kW for heating and approximately −350 kW for cooling, for this example. Thus, the conventional thermal system may typically be sized and configured to generate a peak thermal power of 400 kW in order to meet the peak thermal needs of the facility 106, for example, at the coldest hour on the coldest day of the year. The values used for the thermal loads for heating and/or cooling are intended to be illustrative, and may be any other value(s).

As mentioned above, the thermal power of the thermal system may be at least partly provided to the facility by the GSHP and partly by the supplemental thermal devices as needed. The GSHP may typically be configured to provide only a portion of the peak thermal loads. However, while the GSHP may not meet all of the peak demands, the GSHP may provide a large portion of the total thermal energy to the facility for heating over the course of the year.

The conventional thermal system may typically be configured such that when the facility calls for heating or cooling, the GSHP operates at full capacity to meet the thermal load of the facility. If the GSHP alone meets the demand, the supplemental thermal devices may be shut off until the facility again calls for heating or cooling. Alternatively, if the GSHP cannot meet the demand, the supplemental thermal device may be activated to provide additional thermal power to meet the thermal load. In this way, the GSHP is configured to operate, when activated, at full capacity.

In some embodiments, configuring the GSHP to cover 100% (e.g., all 400 kW) of the peak thermal power demand of the facility may come at the cost of diminished returns. For example, peak thermal loads may occur infrequently such that only a portion of that peak capacity may be needed most of the time. Thus, conventionally, the GSHP may be sized and configured to cover less than 100% of the peak thermal loads, while still providing a significant amount of the total thermal energy. For example, by sizing the GSHP with a thermal power capacity that can cover only about 30% of the peak thermal power (e.g., 127 kW), the GSHP may still provide about 80% of the total thermal energy for the facility for the year. The conventional thermal system may accordingly be configured with supplemental thermal devices 104 that cover up to 70% of the thermal load during peak hours, but may represent a small portion of the total thermal energy provided by the thermal system over the course of a year (e.g., 20%). As the GSHP may typically be much more energy-efficient than the supplemental thermal device, up to 80% of the thermal energy for the facility may be provided through these energy-efficient means, resulting in significant cost and energy savings.

Limiting the thermal power capacity of the GSHP in this way may additionally provide initial or start-up savings associated with the construction and installation of the GSHP and the ground heat exchanger. For example, a significant amount of the expense of implementing a GSHP may be associated with drilling and completing the boreholes of the borefield. Additionally, space may limit the quantity, arrangement, or configuration of the boreholes. Limiting the power capacity of the GSHP (e.g., to 30%) may in turn result in a reduced number of boreholes or reduced length of ground loops that are needed for the operation of the GSHP. Thus, significant up-front capital savings may be achieved by implementing the supplemental thermal devices in addition to the GSHP.

Typically, the borefield of the ground heat exchanger may be dimensioned proportionately to the GSHP. For instance, a quantity of boreholes and/or a quantity of total linear feet of the ground loops may be proportionate to the thermal capacity of the GSHP. In some embodiments, extracting heat from the ground (e.g., during heating) and/or injecting heat to (e.g., during cooling) above that for which the ground heat exchanger is sized and configured may result in the ground temperature changing. The changing ground temperature may adversely affect the ability of the GSHP to provide heating and/or cooling. In some cases, the ground may freeze, which may damage and/or further inhibit the operation of the ground heat exchanger. Accordingly, the ground heat exchanger (e.g., more specifically, the borefield) may be sized proportional to an amount of thermal energy the GSHP is configured to extract and/or inject.

Conventionally, the GSHP may typically be operated at full capacity when the facility calls for heating and/or cooling. The borefield may accordingly be dimensioned such that at full capacity (including during continual operation of the GSHP at full capacity), one or more temperatures associated with the borefield remain within a predetermined temperature threshold (e.g., range). For example, the borefield may be sized such that an average borehole temperature (e.g., of one or more boreholes, at one or more locations, and/or at one or more depths) remains within a temperature threshold. In another example, the borefield may be sized such that a parameter relative to a fluid inlet temperature of the thermal fluid flowing into the ground heat exchanger, such as the fluid inlet temperature and/or an average fluid temperature between the thermal fluid flowing into and out of the ground heat exchanger remains within one or more temperature thresholds. A temperature threshold for the borehole temperature may include a lower limit above freezing, such as 2° C., 3° C., 4° C., 5° C., or any other temperature that is considered as not detrimental for the borefield. A temperature threshold for the fluid inlet temperature may have a lower limit of −3° C., −2° C., −1° C., 0° C., or any other temperature. In some embodiments, a temperature threshold for the borehole temperature includes an upper limit, such as 36° C., 37° C., 38° C., 39° C., 40° C., or any other temperature. A temperature threshold for the fluid inlet temperature may have an upper limit, such as 38° C., 39° C., 40° C., 41° C., 42° C., or any other temperature that is considered as not detrimental for the borefield.

The temperature thresholds may help to prevent damage to the ground due to changing temperatures based on thermal energy injected into and/or extracted from the ground by the GSHP. For example, the temperature threshold(s) having a lower limit may help to prevent the ground from freezing. In some embodiments, the local regulations dictate the upper and/or lower limits of the temperature threshold(s) for the fluid inlet temperature, such as between −2° C. and 40° C. For the purposes of illustration, the discussion herein may specifically reference the fluid inlet temperature for monitoring and/or comparing to a temperature threshold in order to achieve the features and functionalities of the present disclosure. It should be understood, however, that one or more temperatures and/or temperature thresholds may be utilized in accordance with that discussed herein in addition to, or as an alternative to, the fluid inlet temperature.

In some conventional systems, operation of the GSHP causes the temperature of the ground to change over time.

For example, the temperatures may fluctuate cyclically throughout a single year, and in this particular example, decrease on average over the course of 25 years. Other example implementations may see an increase in average temperature (or a relatively constant temperature average) over the course of many years. The change in average temperature may typically be due to the disparity between the amount of thermal energy injected into the ground (e.g., during cooling) and the amount of thermal energy extracted from the ground (e.g., during heating). Implementing the temperature threshold(s) (and in many cases the governmental regulation) as discussed may be in an effort to prevent or reduce the temperature change over time. The specific values illustrated and described in connection with the conventional thermal system are used for the purpose of explaining one illustrative example. It should be understood that the values, metrics, parameters, etc., may take any form or value consistent with that described herein.

In some embodiments, the fluid inlet temperature does not reach −2° C. until nearly 25 years. This is typically by design based on the dimensioning of the GSHP and borefield, as described. In many cases, 25 years (or any other predetermined time period) may represent a useful or expected life of one or more components of the thermal system, at which point the thermal system may be updated, redesigned, reconfigured, etc. In this way, conventional techniques may size and configure the GSHP and/or the borefield based on the predicted temperature change over time.

In some embodiments, a novel thermal system may include one or more components similar to that of the conventional thermal system, such as a GSHP and supplemental thermal devices for providing thermal power to a facility. The GSHP may be in thermal communication with a ground heat exchanger through one or more ground loops. A thermal fluid may flow through the ground loops to facilitate the thermal communication. The ground heat exchanger may include a borefield having one or more boreholes positioned within the ground.

The novel thermal system may additionally include a thermal management system implemented on one or more computing devices, such as one or more client devices. The thermal management system may be in communication with one or more components of the thermal system (e.g., via the network as described herein). In some embodiments, the thermal management system is in communication with one or more of the ground heat exchanger, the GSHP, the supplemental thermal devices, and the facility. The thermal management system may be in communication with any other component or system associated with the thermal system consistent with that described herein.

As discussed above, conventional techniques for implementing the conventional thermal system may operate the GSHP, when activated, at a full capacity. The conventional thermal system may be made to maintain one or more temperatures within certain temperature thresholds based on a proportionate sizing of the GSHP and the borefield. The novel thermal system of the present disclosure, however, may be implemented with a variety of configurations which do not follow the proportionate approach of the conventional configuration, and in this way may be in contrast to the conventional techniques of the conventional thermal system. For purposes of this comparison, it should be understood that the conventional thermal system and the novel thermal system are similar in that they have similar facilities having similar thermal load requirements, are located in similar climates, etc. Indeed, the conventional thermal system and the novel thermal system may be substantially the same with the exception of the notable differences discussed below.

In some embodiments, the novel thermal system is implemented with a configuration A. Configuration A may be a configuration in which the GSHP has a thermal power capacity that is the same or similar to (or even larger than) the GSHP of the conventional configuration, but the borefield is notably dimensioned smaller than the borefield of the conventional configuration. For example, the borefield may be 80% the size of the borefield of the conventional configuration, such as by having 80% of the amount of boreholes, 80% of the total drilled length of boreholes, 80% of the total length of ground loops, etc. (and combinations thereof). In this way, the GSHP of configuration A may be oversized as compared to the borefield (e.g., according to conventional proportions). In some embodiments, the novel thermal system implements a configuration B. Configuration B may be a configuration in which the borefield is dimensioned the same or similar to the borefield of the conventional configuration, but the GSHP may notably have a thermal power capacity that is larger than the GSHP of the conventional configuration. For example, the thermal capacity of the GSHP may be 30% larger than the thermal capacity of the GSHP of the conventional configuration. In this way, the GSHP of configuration B may similarly be oversized as compared to the borefield (e.g., according to conventional proportions). The various features, functionalities, benefits, and advantages of the novel thermal system including the thermal management system will be discussed herein with respect to the novel thermal system implementing configuration A and/or configuration B.

In some embodiments, a thermal management system is implemented in an environment in accordance with one or more embodiments described herein. The environment may include one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via any protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, function, etc., of the novel thermal system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device(s) may similarly refer to various types of computing devices. Each of the devices of the environment may include features and functionalities described below.

The environment may include a thermal management system implemented on one or more computing devices. The thermal management system may be implemented on one or more client devices, server devices, and combinations thereof. Additionally, or alternatively, the thermal management system may be implemented across the client devices and the server devices such that different portions or components of the thermal management system are implemented on different computing devices in the environment. In this way, the environment may be a cloud computing environment, and the thermal management system may be implemented across one or more devices of the cloud computing environment in order to leverage the processing capabilities, memory capabilities, connectivity, speed, etc., that such cloud computing environments offer in order to facilitate the features and functionalities described herein.

The thermal management system may include a data manager, a comparison engine, and a thermal power controller. The thermal management system may also include a data storage having data stored thereon. While one or more embodiments described herein describe features and functionalities performed by specific components of the thermal management system, it will be appreciated that specific features described in connection with one component of the thermal management system may, in some examples, be performed by one or more of the other components of the thermal management system.

By way of example, one or more of the data receiving, gathering, and/or storing features of the data manager may be delegated to other components of the thermal management system. As another example, while data may be processed and/or compared by the comparison engine, in some instances, some or all of these features may be performed by the thermal power controller, or any other component of the thermal management system. Indeed, it will be appreciated that some or all of the specific components may be combined into other components and specific functions may be performed by one or across multiple of the components of the thermal management system.

Additionally, it should be understood that some or all of the features and functionalities of the thermal management system may be implemented on or across multiple client devices and/or server devices. For example, data may be received by the data manager on a (e.g., local) client device, and the data may be input to one or more models or feedback loops implemented by the comparison engine on a remote, server, and/or cloud device. Indeed, it will be appreciated that some or all of the specific components may be implemented on or across multiple client devices and/or server devices, including individual functions of a specific component being performed across multiple devices.

As mentioned above, the thermal management system includes a data manager. The data manager may receive and manage a variety of types of data of the thermal management system. In some embodiments, the data manager receives sensor data. The sensor data may include measurements from any number of sensors included or associated with the novel thermal system. For example, the sensor data may include flow measurements, temperature measurements, and/or pressure measurements of the thermal fluid at one or more locations in the thermal system. The sensor data may include temperature measurements at one or more locations of the borefield, such as ground temperatures, borehole temperatures, grout temperatures, ambient temperatures, or any other temperature. The sensor data may be real-time data and/or may include data taken over a measurement period having one or more statistical calculations performed thereon (e.g., maximum, minimum, average, median, etc.). In this way, the data manager may receive sensor data associated with one or more real-time or active properties of the thermal system.

In some embodiments, the data manager receives inferred data, such as one or more inferred values representative of one or more properties or parameters of the thermal system. For example, in some embodiments, one or more temperatures are inferred for one or more locations of the borefield. For example, the thermal management system may be in communication with a digital twin of the borefield, such as that discussed herein. The digital twin may be generated by a thermal model (discussed below) which may mathematically and/or thermodynamically model the thermal response of the thermal system. The thermal model may include a forward model and may invert the forward model for predicting one or more parameters of the thermal system. The thermal model may be based on one or more measured values, such as temperature(s) and/or flowrate(s) of the thermal fluid. The thermal model may be based on a design (e.g., geometry) of the borefield and/or the completion of the boreholes. Based on the model predictions, the thermal model may generate the digital twin of the borefield, which may include a detailed temperature field or temperature map inferring the temperature at one or more (or all) locations of the borefield. As discussed herein, this may facilitate determining the minimum (e.g., inferred) borefield temperature.

An example implementation of the thermal model is described herein, according to at least one embodiment of the present disclosure. The thermal model may include a forward model. The forward model may be a physical model of the ground heat exchanger. For example, the forward model may be a computational tool that simulates and/or predicts the thermal behavior of the borefield, the ground, the boreholes, etc. The forward model may receive (or may be based on) one or more parameters, and based on receiving one or more inputs, the forward model may predict or estimate one or more output values. In this way, the forward model may provide a detailed representation of the thermal response of the ground heat exchanger due to heat transfer.

In some embodiments, the forward model receives (or is based on) one or more borefield design parameters. The borefield design parameters may include information related to the one or more boreholes of the borefield, such as a trajectory, length, diameter, location, position, layout, configuration, etc., of the boreholes. The borefield design parameters may include any of the design data related to the borefield as described herein.

In some embodiments, the forward model receives (or is based on) one or more completion design parameters. The completion design parameters may include information related to the completion of the boreholes of the borefield, such as a diameter, configuration, length, arrangement, shank spacing, etc., of the ground loops. The completion design parameters may include thermal properties of the ground loops and/or of the thermal fluid circulated in the ground loops.

In some embodiments, the forward model receives (or is based on) one or more initial conditions, such as initial borefield parameters. The initial borefield parameters may include information related to one or more properties of the borefield, such as an initial thermal conductivity of the ground, an initial thermal conductivity of the grout, and/or an initial average temperature of the ground. One or more of the initial borefield parameters may be initial conditions in that they may be initial starting points or estimates of the borefield parameters for use in simulating the thermal response with the forward model (e.g., to output the predicted thermal values). As described below, one or more of the initial borefield parameters may be variables that may be manipulated or changed through implementation of the inverted model in order to determine one or more of the predicted borefield parameters.

The forward model may receive (or may be based on) any other parameter. For example, the forward model may receive one or more boundary conditions such as an ambient air temperature, heat pump condition (e.g., compressor and/or evaporator temperature), heat pump state (e.g., on/off), or any other factor that may influence the heat transfer process. The borefield design parameters and/or the completion design parameters may include information from the data storage. In some embodiments, the borefield design parameters and/or the completion design parameters may be static inputs and, as just mentioned, one or more of the initial borefield parameters may be variables.

In some embodiments, the forward model receives one or more dynamic inputs, or measurement inputs. The measurement inputs may be associated with a flow of the thermal fluid through the ground heat exchanger. For example, the forward model may receive a thermal flux input. The thermal flux input may be a measure of a rate of energy transferred between the thermal fluid and the ground as a result of the thermal fluid flowing through the ground loops (e.g., energy per unit area per unit time, $W/m^2$). The thermal flux input may be measured at one or more locations of the ground heat exchanger, and may be from sensor data.

In some embodiments, the measurement inputs include a flowrate input. The flowrate input may include a volumetric flow rate and/or a mass flow rate of the thermal fluid flowing through the ground heat exchanger. The flowrate input may be measured at one or more locations of the ground heat exchanger, and may be part of the sensor data.

The forward model being based on the borefield design parameters, the completion design parameters, and the initial borefield parameters in this way may facilitate accurately simulating the heat transfer processes of the thermal system (e.g., due to the inputs and/or parameters). For example, the forward model may account for factors such as geophysical properties of the ground, the configuration of the borefield, and operational parameters of the GSHP. The forward model may implement numerical techniques for capturing the interplay between one or more of the inputs and/or parameters in order to accurately characterize the thermal response of the ground heat exchanger. For example, the forward model may incorporate mathematical heat transfer equations, such as a g-function, that describe conductive, convective, radiative, and/or advective heat transfer within the thermal system, as well as the transient nature of heat transfer at changing temperatures. The forward model may implement numerical calculations, finite element analyses, or any other techniques for modeling and solving the heat transfer of the thermal system.

In this way, the forward model may model the temperature distribution and variation within the ground over one or more discrete time intervals in response to a thermal rejection to (or thermal extraction from) the ground by the thermal fluid and/or the ground loops. For example, the forward model may include or may be based on robust heat transfer dynamics and/or equations that capture faster transients within the thermal system. In these situations, the forward model may implement time intervals, such as every 1-5 minutes to simulate a more detailed or faster thermal response of the thermal system. In another example, the forward model may include or may be based on more general or balanced thermodynamics and may accordingly implement longer time intervals, such as every 1-5 hours to simulate a more general thermal response or equilibrium of the thermal system over a longer time period.

In some embodiments, the forward model outputs or predicts one or more predicted thermal values. The predicted thermal values may include predicted values associated with the thermal fluid, such as a predicted inlet temperature of the thermal fluid flowing into the ground heat exchanger, a predicted outlet temperature of the thermal fluid flowing out of the ground heat exchanger, a predicted pressure drop of the thermal fluid at or across one or more locations of the ground heat exchanger. The predicted thermal values may include predicted values associated with the ground, such as a predicted temperature at one or more locations of the ground. In some embodiments, the predicted thermal values are values or parameters of the thermal system that will or can be measured or observed. For example, the predicted thermal values output by the forward model may correspond and may be compared to one or more actual, measured thermal values, such as a measured fluid inlet temperature, measured fluid outlet temperature, measured fluid pressure drop, etc. This may facilitate calibrating, tuning, or training the thermal model, as described herein. The predicted thermal values may include any other value that may be predicted by the forward model consistent with that described herein. In this way, the forward model may characterize the thermal behavior of the ground heat exchanger in order to predict one or more observable values of the thermal system.

As mentioned, the thermal model may include an inverted model. The inverted model may facilitate estimating or predicting one or more of the parameters upon which the forward model is based. In this way, the inverted model may be an inversion or a reversal of the forward model. For example, the forward model may predict, based on the model parameters, one or more values of the thermal system, and the inverted model may facilitate finding the set of model parameters (e.g., in particular borefield parameters) that result in predicted values that best match actual measured values of the thermal system.

For example, as mentioned, the forward model may determine one or more predicted thermal values associated with the thermal system based on a set of initial borefield parameters (among other factors). As described, the data manager may receive sensor data including the measured thermal values. In some embodiments, the inverted model compares the predicted thermal values to the measured thermal values. For example, the inverted model may include or may define an objective function or cost function that quantifies a target difference between one or more of the predicted thermal values and the measured thermal values for the set of parameters used by the forward model (e.g., used for a given iteration performed by the forward model). In some embodiments, the inverted model finds the set of parameters that minimizes this target difference. For example, the inverted model may iteratively adjust or modify one or more (or all) of the initial borefield parameters in order to iteratively change or modify the predicted thermal values that the forward model outputs.

In some embodiments, the inverted model includes or defines an optimization algorithm or engine in order to find the best-fit values for the initial borefield parameters. For example, the inverted model may try and/or modify different combinations of the initial borefield parameters to yield a sufficient or desirable target difference. In some embodiments, the inverted model functions iteratively in this way until a convergence occurs for the target difference. For example, the inverted model may iterate until the target difference is within a predetermined threshold, such as substantially 0. In another example, the inverted model may iterate until a change in the target difference is within a predetermined threshold (e.g., for a threshold quantity of consecutive iterations). In another example, the inverted model may iterate until a minimum (or least) target difference is found, such as by iterating through a predetermined quantity of (or all) iterations.

In this way, the inverted model may iteratively generate the predicted thermal values and compare those values to the measured thermal values in order to determine a set of best-fit borefield parameters. The inverted model may output these best-fit parameters as predicted borefield parameters. For example, the predicted borefield parameters may include a ground thermal conductivity (k) and a grout thermal conductivity (kg). The predicted borefield parameters may include an average temperature ($T_0$) of the ground and/or a current temperature (T) of the ground in one or more locations of the ground in the neighborhood of the borefield. The average temperature $T_0$ may be an average far-field or undisturbed ground temperature. The borefield parameters may be associated with one or more depths within the ground, or may be associated with the ground heat exchanger generally (e.g., an average). In this way, the predicted borefield parameters may represent an inference of one or more properties or parameters of the ground heat exchanger. In some embodiments, determining (e.g., measuring) an actual value of one or more of the predicted borefield parameters may not be possible, may be prohibitively difficult or not feasible, or may be cumbersome in practice. By inferring the predicted borefield parameters in this way, the thermal model may facilitate understanding a state, change, condition, etc., of one or more of the thermal properties of the thermal system which may otherwise not be known. As discussed herein, generating the predicted borefield parameters may facilitate monitoring, analyzing, and/or controlling one or more aspects of the thermal system.

The thermal model may be implemented in order to determine the predicted borefield parameters. In some embodiments, the thermal model iteratively and/or continuously determines the predicted borefield parameters. For example, the thermal model may update the predicted borefield parameters one or more times over a predetermined time interval. For instance, the thermal model may receive the inputs (e.g., thermal flux input and/or flowrate input) at discrete time intervals such as every 1 minute, 2 minutes, 3 minutes, 4 minutes, 5 minutes, or up to every 1 hour, 2 hours 3 hours, or more. The inputs may include an actual measured value and/or may include a statistical value such as an average, mean, median, mode, maximum, minimum, etc., calculated over several time intervals. In this way, the thermal model may receive the inputs as live or real-time data inputs. The thermal model may accordingly update the predicted borefield parameters in real time based on the live data inputs. In this way, the thermal model may facilitate a real-time estimation or inference of the predicted borefield parameters to simulate changes in the thermal response over predetermined time intervals based on heat extracted or injected by the GSHP.

The thermal model functioning based on the inputs and parameters discussed above, in this way, may facilitate determining the predicted borefield parameters during operation of the thermal system and/or the GSHP. For example, the borefield design parameters and the completion design parameters may include static values that may be known or calculated, for example, based on the design, construction, etc., of the thermal system. Additionally, the thermal flux input and the flowrate input may include values and/or may be calculated from values that are received and/or measured by the data manager during operation of the thermal system, such as with temperature sensors, flow sensors, pressure sensors, etc. The predicted borefield parameters may accordingly be determined during operation of the thermal system based on this information that is known and/or collected during operations. In this way, the thermal management system may provide the features and functionalities discussed herein without having to put the thermal system offline.

In some embodiments, the thermal management system utilizes the predicted borefield parameters to generate and/or implement a digital twin. The digital twin may be a digital representation of one or more aspects of the ground heat exchanger and/or the borefield. For example, based on the predicted borefield parameters, the digital twin may infer one or more other parameters, properties, and/or states of the thermal system.

In some embodiments, the digital twin indicates a temperature of the borefield and/or the ground at one or more locations. For example, given the known geometry and configuration of the ground heat exchanger, as well as the flow measurements of the thermal fluid, and by incorporating the thermal properties of the ground (e.g., the predicted borefield parameters) the model engine may generate a detailed temperature map of the borefield. The digital twin may indicate one or more temperatures with respect to a (e.g., 2- or 3-dimensional) spatial coordinate. For example, the digital twin may indicate a 2- or 3-dimensional grid consisting of individual cells associated with a specific location in the borefield. The size and/or quantity of cells may vary depending on a desired level of detail for the digital twin. For each cell in the grid, the thermal management system may determine a temperature based on a physical modelling of the heat transfer to that location by implementing heat transfer equations and/or numerical methods (e.g., similar to that used in connection with the forward model). The thermal management system may incorporate lithology data for the ground, data from thermal response tests, laboratory testing, or any other data such as data from the data storage. In some embodiments one or more methods of interpolation are implemented for estimating temperatures at the boundaries of cells of the grid and/or between cells. In this way, a continuous temperature field may be generated for an area of interest (or all of) the borefield via the digital twin.

In some embodiments, the thermal management system generates a plot, or a visual representation of the digital twin. For example, the thermal management system may implement color mapping or shading to represent different temperatures of the temperature field in order to generate a 2- or 3-dimensional temperature map of the borefield. In some embodiments, the thermal management system displays the digital twin via a graphical user interface. In this way, the digital twin may be visually represented and presented in order that a user may analyze and/or interpret the inferred temperatures of the borefield.

In some embodiments, the data manager receives user input. The data manager may receive the user input, for example, via any of the client devices and/or server devices.

Any of the data described herein may be input or augmented via the user input. For example, in some instances, some or all of the sensor data may be received by the data manager as user input. In some instances, some or all of the inferred data may be received by the data manager as user input. As will be described herein, one or more functions or features of the thermal management system may be facilitated by receiving user input. The data manager may save and/or store any of the data it receives to the data storage.

As discussed above, the thermal system may be configured (e.g., configuration A, configuration B, etc.) such that the GSHP is oversized with respect to the borefield. Operating the GSHP in this way may cause the fluid inlet temperature to exceed the temperature threshold. For example, the conventional GSHPs discussed herein are sized such that the fluid inlet temperature reaches the temperature threshold only after nearly 25 years, even when operating at full capacity. In contrast, the oversized GSHP of the thermal system (e.g., at full capacity) may cause the fluid inlet temperature to reach or exceed the temperature threshold much earlier than 25 years, such as within 2 years, within 1 year, or immediately.

In order to facilitate implementing the oversized GSHP, the thermal management system includes a comparison engine and a thermal power controller. The comparison engine may facilitate monitoring a temperature associated with the borefield of the thermal system against the more temperature thresholds, and the thermal power controller may control an operation of the GSHP in order to control a thermal output of the GSHP. For example, the comparison engine may monitor the fluid inlet temperature received by the data manager. In some embodiments, the comparison engine performs one or more (e.g., statistical) calculations on the fluid inlet temperature, such as to find a mean, median, average, minimum, maximum, etc., over a time interval. In some embodiments, the comparison engine determines a trend and/or predicts a future value for the fluid inlet temperature. The comparison engine may compare any of these temperature values of the temperature related to the ground temperature to an associated temperature threshold. For example, the comparison engine may compare the inlet temperature to a temperature threshold lower limit of −2° C. In another example, the comparison engine may compare the fluid inlet temperature to a temperature threshold upper limit of 40° C.

Based on the comparison, the comparison engine may generate and send a signal to the thermal power controller. For example, if the temperature associated with the borefield (such as the inlet temperature) is greater than −2° C., the comparison engine may indicate to the thermal power controller to continue operation of the GSHP (e.g., at full capacity). In another example, if the temperature associated with the borefield (such as the inlet temperature) exceeds −2° C., the comparison engine may indicate to the thermal power controller to adjust, or stop, the thermal power output of the GSHP. In another example, as the inlet temperature approaches or trends towards −2° C., the comparison engine may indicate to the thermal power controller to throttle the GSHP or to reduce a thermal power output of the GSHP to prevent the inlet temperature from falling below −2° C. In another example, the comparison engine may predict or forecast a future value of the inlet temperature, and the thermal power controller may accordingly control the thermal power output of the GSHP based on the future prediction. In some embodiments, the thermal power output of the GSHP is controlled to maintain the inlet temperature at a desired setpoint, such as at or near the temperature threshold. The comparison engine in connection with the thermal power controller may implement a feedback control loop to adjust the thermal power output of the GSHP and/or to control the fluid inlet temperature of the thermal system.

The thermal power controller may control the thermal power output of the GSHP in a variety of ways. For example, in some embodiments, the thermal power controller adjusts the duty cycle of a compressor and/or modulates the speed of a variable speed compressor of the GSHP. In some embodiments, the GSHP includes multiple stages, and the thermal power controller facilitates operating one or more of the stages in order to run the GSHP at different capacities. In some embodiments, the thermal power controller adjusts one or more modulating valves for controlling the flow rate of thermal fluid associated with the GSHP. In some embodiments, the thermal power controller adjusts one or more temperature setpoints and/or schedules for the facility to change a thermal load demanded by the facility. In some embodiments, the thermal power controller implements load shifting techniques by, for example, charging a thermal storage during non-peak hours, and supplementing the GSHP with the thermal storage in order to shift some or all of the thermal load from the GSHP. The thermal power controller may implement control algorithms in order to optimize the operation of the GSHP (or any other component of the thermal system) based on load requirements and predictions, occupancy patterns, weather forecasts, etc. The thermal power controller may operate in this way to control the GSHP for both heating and cooling conditions. In this way, the thermal power controller may implement one or more (and combinations) of techniques for adjusting the thermal power generated by the GSHP. The thermal power generated by the GSHP may correspond directly with and/or may influence the fluid inlet temperature of the thermal system based on an amount of energy extracted or injected into the ground.

As mentioned above, the thermal management system may regulate the thermal output of the GSHP based on the fluid inlet temperature. The GSHP may operate at a full capacity (e.g., when activated) until the fluid inlet temperature is at or near the fluid inlet temperature, in which case the thermal power output of the GSHP is modulated or controlled to maintain the fluid inlet temperature above the temperature threshold. The fluid inlet temperature never falls below the temperature threshold of −2° C. In contrast, the fluid inlet temperature of the conventional thermal system reaches the temperature threshold of −2° C. just once, by sizing design, during the $25^{th}$ year, despite the GSHP only operating at full capacity (e.g., no controlling of thermal power). In this way, the GSHP of the novel thermal system may be oversized compared to the GSHP of the conventional thermal system, but the novel thermal system may still operate within the fluid inlet temperature threshold of −2° C. by limiting, at times, the thermal power capacity of the GSHP.

While the novel thermal system has been described primarily with respect to a lower temperature threshold, such as −2° C., and maintaining the inlet temperature above the lower temperature threshold during heating, it should be understood that the novel thermal system, and the thermal management system, may be configured similarly for providing cooling. For example, the thermal management system may control the thermal power of the GSHP to maintain the inlet temperature below an upper temperature threshold, such as 40° C. during cooling. In this way, the features and functionalities of the novel thermal system may apply equally to heating conditions and cooling conditions (or both).

The GSHP being oversized in this way, and being actively controlled based on a temperature associated with the ground temperature, such as the fluid inlet temperature, may result in an increased amount of energy extracted from (or injected to) the ground, while still operating within the operational (or regulatory) temperature thresholds. In some embodiments, the thermal power provided by the GSHP of the conventional thermal system has a maximum of about 127 kW, based on the conventional sizing and configuration of the GSHP as described above. The GSHP may operate in this way without the fluid inlet temperature reaching the temperature threshold until nearly 25 years. In contrast, the thermal power output of the GSHP of the novel thermal system is controlled and/or modulated in order to maintain the fluid inlet temperature at or above the temperature threshold. This results in the GSHP extracting more thermal energy from the ground as compared to the conventional thermal system. A similar effect may occur for the cooling provided by the respective thermal systems.

In this way, the novel thermal system may generate more thermal power by actively controlling the GSHP to comply with the fluid inlet temperature and/or ground temperature thresholds, in contrast to the conventional thermal system, which permanently limits the power capacity, and consequently the thermal power outlet, to meet the temperature threshold requirements.

In some embodiments, the fluid inlet temperature of the novel thermal system may reach the temperature threshold of −2° C. almost immediately (e.g., within the first year), but the active modulation of the thermal power of the GSHP may maintain the fluid inlet temperature (e.g., during the heating months) at or above the temperature threshold for the duration of the 25-year period (and beyond). Similarly, the borehole temperature may fall below 5° C. within the first year and may generally maintain at that temperature (e.g., during the heating months) for the duration of the 25 years. This may be in contrast to that discussed above in connection with the conventional thermal system, in which the fluid inlet and borehole temperatures decrease on average over time until they reach the threshold temperature(s) near the $25^{th}$ year.

In some embodiments, the thermal power output by the GSHP of the novel thermal system may not be constant over the entire 25-year period. For example, the coverage of the GSHP may be higher (e.g., about 88%) during the initial years and may converge over time toward a lower value (e.g., about 82.5%). In contrast, the coverage of the GSHP of the conventional thermal system may be relatively constant (e.g., about 83%) for the entire duration of the 25-years. While the relative generation of the GSHP of the novel thermal system may eventually converge to a lower value than that of the GSHP of the conventional thermal system, the increased amount of thermal energy achieved during the earlier years may offset the slight losses (comparative to the conventional GSHP) during the later years such that the average coverage over the useful lifespan of the novel thermal system (e.g., 25 years) may be greater for the GSHP of the conventional thermal system.

The GSHP of the novel thermal system being oversized in a variety of ways with respect to the borefield, which may provide specific benefits in connection with the features and functionalities of the novel thermal system discussed herein. For example, as mentioned above, the novel thermal system may be configured with configuration A or configuration B, or other configurations, and combinations thereof.

In accordance with configuration A, the GSHP may have a thermal power capacity that is the same or similar to (or even somewhat greater) than that of the conventional GSHP. Notably, however, is that the borefield for configuration A may be smaller (e.g., have a shorter total drilled length) in relation to the borefield of the conventional configuration. By implementing the techniques described herein to actively control the GSHP based on the fluid inlet temperature, the novel GSHP may provide the same heating coverage as the conventional GSHP, but may do so with a smaller overall borefield. In some embodiments, the novel GSHP additionally achieves increased thermal performance for cooling over that of the conventional GSHP, even with a smaller borefield. Thus, configuration A may provide benefits such as reducing the initial burden and/or cost of installing and constructing the thermal system, reducing the maintenance and/or upkeep of the ground heat exchanger, reducing the amount of thermal fluid to circulate through the ground heat exchanger, and facilitating implementation of the ground heat exchanger in a smaller area. In this way, the GSHP of configuration A may provide increased performance despite having a proportionately smaller borefield. Similar benefits may be achieved (e.g., to a greater effect) through implementation of configuration B.

In accordance with configuration B, the borefield may have a same or similar size to that of the borefield of the conventional thermal system, but the novel GSHP may have a significantly larger thermal capacity (e.g., 30% larger) than that of the conventional GSHP. By implementing the techniques described herein to actively control the GSHP based on the fluid inlet temperature, the novel GSHP may provide more heating coverage than the conventional GSHP from substantially the same borefield. In some embodiments the novel GSHP additionally achieves increased thermal performance for cooling over that of the conventional GSHP to an even greater degree. Thus, configuration B may provide benefits such as fulfilling more of the thermal load of the facility with energy- and cost-efficient heating/cooling means, increasing the total (e.g., peak) thermal power output of the novel thermal system, reducing the required capacity of the supplemental thermal device, and reducing the CO2 emissions of the novel thermal system, all without the need for a larger borefield.

The novel thermal system has been primarily described with respect to controlling the GSHP based on a temperature threshold for the temperature associated with the borefield intended to prevent the ground from freezing, such as −2° C. In some embodiments, a temperature threshold is implemented to facilitate preventing the thermal fluid from freezing. For example, the temperature threshold may be 2° C., 3° C., 4° C., 5° C., or any other value. Preventing freezing of the thermal fluid with the temperature threshold in this way may prevent damage, inefficiencies, and/or disruptions of an operation of the thermal system. Additionally, maintaining the thermal fluid above freezing in this way may facilitate utilizing water as the thermal fluid. For example, in many cases, an antifreeze additive such as glycol or brine may be mixed with the thermal fluid (e.g., water) in order to lower a freezing point of the thermal fluid and facilitate implementing the thermal fluid at lower temperatures. These additives used in the thermal fluid mixtures may be expensive, especially when considering the volume of thermal fluid in circulation in the thermal system (e.g., including over 4000 linear feet of ground loops). Thus, utilizing water as the thermal fluid, and maintaining the fluid inlet temperature above freezing, may eliminate the need for anti-freeze additives which may provide additional cost, material, and/or maintenance savings.

As mentioned above in connection with the data manager, a digital twin may be generated by a thermal model which, based on one or more measured values of the novel thermal system, may be trained, calibrated, and validated to accurately predict certain properties of the borefield such as a ground thermal conductivity, a grout thermal conductivity, and/or an average far-field or undisturbed ground temperature. Based on these predicted borefield properties, the thermal model may generate the digital twin to infer the temperature at one or more (or all) locations of the borefield. The thermal model may predict the borefield properties and generate the digital twin in real time and during operation of the GSHP. In this way, the digital twin may provide a live overview of temperatures within the ground.

In some embodiments, the thermal management system controls the thermal system based on the digital twin. For example, the thermal management system may monitor the digital twin to determine a minimum temperature of any location in the borefield. The thermal management system may modulate the thermal power output of the GSHP to maintain the borefield above freezing (e.g., 0° C.) at all locations. For example, in some cases the fluid inlet temperature may be maintained above the temperature threshold (e.g., −2° C.) as a proxy for preventing the ground from freezing. However, in some instances, the ground may nevertheless freeze despite the fluid inlet temperature being above the temperature threshold. Thus, the digital twin may facilitate controlling the thermal output of the GSHP based on actual (e.g., inferred) minimum ground temperature to ensure that the ground does not freeze, for example, instead of relying on the fluid inlet temperature threshold to act as a proxy, which may not always accurately reflect the condition of the ground temperature in one or more locations.

In some embodiments, the thermal management system controls the thermal system based on both the digital twin and the temperature threshold for the inlet temperature. For example, as just mentioned, the thermal management system may regulate the GSHP based on the fluid inlet temperature, but the ground may nevertheless freeze. Similarly, in another example, the ground temperature may remain above freezing, but the fluid inlet temperature may nevertheless fall below −2° C. (e.g., which may violate an inlet temperature threshold). The thermal management system may accordingly control the thermal power output of the GSHP to maintain both the fluid inlet temperature above the temperature threshold, and to maintain the inferred minimum ground temperature of the digital twin above freezing. For example, either temperature metric approaching an associated threshold may cause the thermal management system to adjust (e.g., reduce) the thermal power output of the GSHP to ensure that the temperature(s) do not fall below the associated threshold(s). In this way, the thermal management system may control the thermal system based on both the fluid inlet temperature and the digital twin in order to ensure that the ground does not freeze, while also ensuring compliance with any associated fluid inlet temperature regulations.

In some embodiments, a series of acts for operating a GSHP is described herein, according to at least one embodiment of the present disclosure.

In some embodiments, the method includes an act of generating a thermal power based on a thermal communication of the GSHP with a borefield. For example, a thermal fluid may flow between the GSHP and the borefield. The thermal power may at least partly cover a thermal load of a facility. In some embodiments, the thermal power covers at least 80% of a total thermal energy to the facility for heating. In some embodiments, the thermal power covers at least 96% of a total thermal energy from the facility for cooling.

In some embodiments, the method includes an act of receiving a temperature associated with the borefield. For example, the temperature may be a fluid inlet temperature of a thermal fluid flowing into the borefield. In another example, the temperature may be a minimum borefield temperature at any point in the borefield. The minimum temperature may be an inferred minimum temperature and may be based on a digital twin of the borefield generated by a thermal model. For example, the thermal model may predict borefield properties by inverting a forward model of the borefield in real time and during operation of the GSHP. The borefield properties may include one or more of a predicted ground thermal conductivity, a predicted grout thermal conductivity, and a predicted far-field ground temperature. The digital twin may be generated based on a borehole geometry for one or more boreholes of the borefield and/or a completion geometry for a completion of the one or more boreholes.

In some embodiments, the method includes an act of controlling the thermal power based on the temperature. For example, controlling the thermal power of the GSHP may include controlling a flow rate of the thermal fluid. In another example, controlling the thermal power of the GSHP may include controlling a duty cycle or a speed of a compressor of the GSHP.

In some embodiments, the method includes an act of maintaining the temperature within a temperature threshold based on controlling the thermal power, wherein the GSHP is configured to cause the temperature to exceed the temperature threshold at a full capacity of the thermal power. For example, controlling the thermal power of the GSHP may include operating the GCHP at a full capacity of the thermal power until the temperature reaches the temperature threshold, and when the temperature reaches the temperature threshold, throttling the ground-source heat pump to prevent the temperature from surpassing the temperature threshold. In another example, controlling the thermal power of the GSHP may include operating the GSHP at less than full capacity of the thermal power when the temperature reaches the temperature threshold. In some embodiments, the temperature threshold is a temperature threshold of the fluid inlet temperature. For example, the temperature threshold may have a lower limit of −2° C. In some embodiments, the temperature threshold is a temperature threshold of the minimum borefield temperature inferred by the digital twin. For example, the temperature threshold may include a lower limit above 0° C. In some embodiments, the GSHP is configured to cause the temperature to fall below the temperature threshold at a full capacity of the thermal power based on the GSHP being oversized with respect to the borefield.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). In some embodiments, a combination of processors (e.g., an ARM and DSP) could be used.

The computer system also includes memory in electronic communication with the processor. The memory may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitation, an embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer-readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HD DVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.17 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

The following are non-limiting examples of embodiments of the present disclosure:

1. A method of operating a ground-source heat pump, comprising:
   - generating a thermal power based on a thermal communication of the ground-source heat pump with a borefield, the thermal power at least partly covering a thermal load of a facility;
   - receiving a temperature associated with the borefield;
   - controlling the thermal power based on the temperature; and
   - maintaining the temperature within a temperature range defined in relationship to one or more temperature thresholds based on controlling the thermal power, wherein the ground-source heat pump is configured to cause the temperature to fall outside of the temperature range at a full capacity of the thermal power.

2. The method of 1, wherein the temperature is an inlet temperature of a thermal fluid flowing into the borefield.
3. The method of 2, wherein the temperature reaches the one or more temperature thresholds before 25 years of operation of the ground-source heat pump.
4. The method of 2 or 3, wherein the temperature range includes a lower limit of −2° C.
5. The method of any of 1-4, wherein the temperature is a minimum borefield temperature at any location in the borefield.
6. The method of 5, wherein the temperature is inferred based on a digital twin of the borefield generated by a thermal model.
7. The method of 6, wherein the digital twin is generated based on borefield properties predicted by an inverting a forward model, optionally in real time and/or during operation of the ground-source heat pump.
8. The method of 7, wherein the forward model is generated based on a borehole geometry for one or more boreholes of the borefield and/or a completion geometry for a completion of the one or more boreholes.
9. The method of 7 or 8, wherein the forward model is generated based on a flowrate of thermal fluid flowing through the ground-source heat pump and/or a thermal flux between the thermal fluid and the borefield.
10. The method of any of 7-9, wherein the borefield properties include one or more of a predicted ground thermal conductivity, a predicted grout thermal conductivity, and a predicted far-field ground temperature.
11. The method of any of 6-10, wherein receiving the temperature associated with the borefield includes predicting a predicted temperature associated with the borefield (wherein the predicted temperature is at a later time that the current time) and controlling the thermal power (at the current time) is based on the predicted temperature.
12. The method of 7-11, wherein the forward model includes minimizing a target difference between one or more predicted values of properties for a thermal fluid flowing through the borefield and one or more measured values of the corresponding properties.
13. The method of 12, wherein the properties of the thermal fluid optionally include one or more of a predicted inlet temperature of the thermal fluid flowing into the ground heat exchanger, a predicted outlet temperature of the thermal fluid flowing out of the ground heat exchanger, a predicted flow rate of the thermal fluid through the ground heat exchanger, and a predicted fluid pressure drop of the thermal fluid
14. The method of 5-13, wherein the temperature range includes a lower limit above 0° C.
15. The method of any of 1-14, wherein the ground-source heat pump being configured to cause the temperature to fall outside of the temperature range at a full capacity of the thermal power is based on the ground-source heat pump being oversized with respect to the borefield.
16. The method of 15, further comprising covering at least 80% of a total thermal energy to the facility for heating with the thermal power.
17. The method of 15 or 16, further comprising covering at least 96% of a total thermal energy from the facility for cooling with the thermal power.
18. The method of any of 1-17, wherein controlling the thermal power of the ground-source heat pump includes operating the ground-source heat pump at the full capacity of the thermal power until the temperature reaches one of the one or more temperature thresholds, and when the temperature reaches said temperature threshold, throttling the ground-source heat pump to prevent the temperature from falling outside of the temperature range.
19. The method of any of 1-18, wherein controlling the thermal power includes operating the ground-source heat pump at less than the full capacity of the thermal power when the temperature reaches one of the one or more temperature thresholds.
20. The method of any of 1-19, wherein the thermal communication is based on a thermal fluid flowing between the ground-source heat pump and the borefield and controlling the thermal power of the ground-source heat pump includes controlling a flow rate of the thermal fluid.
21. The method of any of 1-20, wherein controlling the thermal power of the ground-source heat pump includes controlling a duty cycle or a speed of a compressor of the ground-source heat pump.
22. The method of any 1-21, further including activating supplemental thermal devices when the temperature reaches one of the one or more temperature thresholds.
23. A system, comprising:
    at least one processor;
    memory in electronic communication with the at least one processor; and
    instructions stored in the memory, the instructions being executable by the at least one processor to:
        generate a thermal power based on a thermal communication of the ground-source heat pump with a borefield, the thermal power at least partly covering a thermal load of a facility;
        receive a temperature associated with the borefield;
        control the thermal power based on the temperature; and
        maintain the temperature within a temperature range defined in relationship with one or more temperature thresholds based on controlling the thermal power, wherein the ground-source heat pump is configured to cause the temperature to fall outside of the temperature range at a full capacity of the thermal power.
24. The system of 23, further including one or more supplemental thermal devices.
25. The system of 23 or 24, wherein instructions stored in the memory include instructions to perform one or more of the operations described hereinabove in relationship to 1-22.
26. A computer-readable storage medium including instructions that, when executed by at least one processor, cause the processor to:
    generate a thermal power based on a thermal communication of the ground-source heat pump with a borefield, the thermal power at least partly covering a thermal load of a facility;
    receive a temperature associated with the borefield;
    control the thermal power based on the temperature; and maintain the temperature within a temperature range defined in relationship with one or more temperature thresholds based on controlling the thermal power, wherein the ground-source heat pump is configured to cause the temperature to fall outside of the temperature range at a full capacity of the thermal power.

27. The computer-readable storage medium of 26, wherein instructions stored in the computer-readable storage medium include instructions to perform one or more of the operations described hereinabove in relationship to 1-22.

The embodiments of the thermal management system have been primarily described with reference to wellbore and/or borefield applications. The thermal management system described herein may be used in applications other than in association with one or more wellbores. In other embodiments, the thermal management system according to the present disclosure may be used outside of a wellbore and/or downhole environment. For instance, the thermal management system of the present disclosure may be used in connection with air-source heat pumps, water-source heat pumps, or any other thermal system, heat transfer engine, or thermal cycle. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of operating a ground-source heat pump, comprising:

generating a thermal power based on a thermal communication of the ground-source heat pump with a borefield, the thermal power at least partly covering a thermal load of a facility;

providing a forward model of the borefield based on initial borefield parameters;

generating predicted thermal values based on the forward model, the predicted thermal values including a temperature associated with the borefield, wherein the temperature is a minimum borefield temperature at any location in the borefield;

developing an inverted model of the borefield based on the forward model;

measuring actual thermal values of the borefield based on sensor data;

comparing the actual thermal values to the predicted thermal values using the inverted model to determine thermal target differences;

iteratively adjusting the initial borefield parameters using the inverted model based on the thermal target differences to iteratively update the forward model;

controlling the thermal power based on the minimum borefield temperature; and maintaining the minimum borefield temperature within a temperature range defined in relationship to one or more temperature thresholds based on controlling the thermal power, wherein the ground-source heat pump is configured to cause the minimum borefield temperature to fall outside of the temperature range at a full capacity of the thermal power, wherein controlling the thermal power includes keeping the ground-source heat pump in an on state and running the ground-source heat pump at less than the full capacity of the thermal power when the temperature reaches one of the one or more temperature thresholds.

2. The method of claim 1, wherein the inverted model finds best-fit values for the initial borefield parameters where the thermal target differences are within a predetermined threshold range.

3. The method of claim 1, wherein the forward model is generated based on a borehole geometry for one or more boreholes of the borefield and/or a completion geometry for a completion of the one or more boreholes.

4. The method of claim 1, wherein the forward model is generated based on a flow rate of thermal fluid flowing through the ground-source heat pump and/or a thermal flux between the thermal fluid and the borefield.

5. The method of claim 1, wherein the borefield parameters include one or more of a predicted ground thermal conductivity, a predicted grout thermal conductivity, and a predicted far-field ground temperature.

6. The method of claim 1, wherein the initial borefield parameters include one or more of an initial thermal conductivity of the ground and an initial average temperature of the ground.

7. The method of claim 6, wherein the predicted thermal values include one or more predicted values of properties for a thermal fluid flowing through the borefield, the actual thermal values include one or more measured values of the properties for the thermal fluid, and the inverted model minimizes the thermal target differences between the one or more predicted values and the one or more measured values.

8. The method of claim 7, wherein the properties of the thermal fluid include one or more of a predicted inlet temperature of the thermal fluid flowing into a ground heat exchanger, a predicted outlet temperature of the thermal fluid flowing out of the ground heat exchanger, a predicted flow rate of the thermal fluid through the ground heat exchanger, and a predicted fluid pressure drop of the thermal fluid.

9. The method of claim 1, wherein the ground-source heat pump being configured to cause the temperature to fall outside of the temperature range at the full capacity of the thermal power is based on the ground-source heat pump being oversized with respect to the borefield.

10. The method of claim 1, wherein controlling the thermal power of the ground-source heat pump includes operating the ground-source heat pump at the full capacity of the thermal power until the temperature reaches one of the one or more temperature thresholds, and when the temperature reaches said temperature threshold, throttling the ground-source heat pump to prevent the temperature from falling outside of the temperature range.

11. The method of claim 1, wherein the one or more temperature thresholds include one or more of a fluid inlet temperature with a lower limit of −2° C., and the minimum borefield temperature with a lower limit above 0° C.

12. The method of claim 1, wherein the thermal communication is based on a thermal fluid flowing between the ground-source heat pump and the borefield and controlling the thermal power of the ground-source heat pump includes controlling a flow rate of the thermal fluid.

13. The method of claim 1, wherein controlling the thermal power of the ground-source heat pump includes controlling a duty cycle or a speed of a compressor of the ground-source heat pump.

14. The method of claim 1, further including activating supplemental thermal devices when the temperature reaches one of the one or more temperature thresholds.

* * * * *